US009518432B2

(12) United States Patent
Miranda et al.

(10) Patent No.: US 9,518,432 B2
(45) Date of Patent: Dec. 13, 2016

(54) TUBULAR PIPE HANDLING APPARATUS HAVING A CHASSIS, AND INCLINED PLANE, A TRAY WITH AN EXTENSION AND SIDE RACKS, RELATED RACK LIFTING MEANS AND SUPPORT AND LIFTING LEGS

(71) Applicant: VTK LLC, Dover, DE (US)

(72) Inventors: Diego Miranda, Rio Negro (AR); Sergio Miranda, Rio Negro (AR)

( * ) Notice: Subject to any disclaimer, the term of this patent is extended or adjusted under 35 U.S.C. 154(b) by 96 days.

(21) Appl. No.: 14/401,807

(22) PCT Filed: May 15, 2013

(86) PCT No.: PCT/US2013/041146

§ 371 (c)(1),
(2) Date: Nov. 17, 2014

(87) PCT Pub. No.: WO2013/173459

PCT Pub. Date: Nov. 21, 2013

(65) Prior Publication Data

US 2015/0184472 A1 Jul. 2, 2015

(30) Foreign Application Priority Data

May 16, 2012 (AR) ..... P120101738

(51) Int. Cl.
*E21B 19/14* (2006.01)
*E21B 19/15* (2006.01)

(52) U.S. Cl.
CPC ..... *E21B 19/155* (2013.01)

(58) Field of Classification Search
CPC ..... E21B 19/155; E21B 19/15; E21B 19/14
(Continued)

(56) References Cited

U.S. PATENT DOCUMENTS 2,958,430 A * 11/1960 Robishaw ..... E21B 19/155
414/22.52
3,159,286 A * 12/1964 Freeman, Sr. ..... E21B 19/155
414/22.61

(Continued)

FOREIGN PATENT DOCUMENTS

CA 2720802 A1 * 5/2012 ..... E21B 19/155

OTHER PUBLICATIONS

Search Report for PCT/US2013/041146, mailed Aug. 19, 2013.
Written Opinion for PCT/US2013/041146, mailed Aug. 19, 2013.

*Primary Examiner* — Gregory Adams
(74) *Attorney, Agent, or Firm* — Marshall, Gerstein & Borun LLP

(57) ABSTRACT

A tubular pipe handling apparatus consisting of a chassis, an inclined plane, a tray with an extension and side racks, that comprises: a tube lifting tray with detachable rotatable extension on its end, to reach the wellhead center, wherein said tray is actuated from its rear portion and pushed to be transferred when supported by the inclined plane; at least a pair of racks on one side of the apparatus have a hinge system with pin block on the hinge or self-lock to perfectly align and lock at 90 degrees, being the assembly bolted to the main body of the chassis; a rack lifting means that inclines the rack and also transfers tubes from and outwardly from the rack independently to storage racks or pipe baskets; an inclined plane, which total length is adjustable by means of extensions to accommodate the required operation height of the substructure, with extensions that are assembled with each other with threaded fasteners and having a centering pin; and four support and lifting legs included in the chassis that elevate the apparatus to place it on a trailer for transport. Said rack lifting means and said support and lifting legs incorporated in tube loading and unloading equipment or
(Continued)

pipe baskets and equipment that require transportation, respectively.

19 Claims, 29 Drawing Sheets

(58) Field of Classification Search
USPC ..... 193/17; 414/22.51–22.59, 22.61–22.69, 414/745.7, 746.4
See application file for complete search history.

(56) References Cited

U.S. PATENT DOCUMENTS 3,169,645 A * 2/1965 Freeman, Sr. ..... E21B 19/155 414/22.59
3,253,721 A * 5/1966 Lakins ..... B23B 13/00 221/254
3,288,310 A * 11/1966 Sherman ..... B60P 3/41 414/139.4
4,067,453 A * 1/1978 Moller ..... E21B 19/155 175/85
6,899,510 B2 * 5/2005 Morelli ..... E21B 19/155 414/22.61
7,404,697 B2 * 7/2008 Thompson ..... E21B 19/155 414/22.58
7,837,426 B2 * 11/2010 Lesko ..... E21B 19/15 414/22.62
8,157,495 B1 * 4/2012 Randall ..... E21B 19/14 414/22.55
2008/0263990 A1 * 10/2008 Morelli ..... E21B 19/14 52/650.3
2009/0053013 A1 2/2009 Maltby
2009/0196711 A1 * 8/2009 Gerber ..... E21B 19/15 414/22.58
2009/0279987 A1 11/2009 Jantzen
2010/0068006 A1 3/2010 Littlewood et al.
2011/0030942 A1 2/2011 Orgeron
2011/0044787 A1 2/2011 Fikowski et al.
2011/0070054 A1 * 3/2011 Crossley ..... E21B 19/14 414/22.61

* cited by examiner

TUBULAR PIPE HANDLING APPARATUS HAVING A CHASSIS, AND INCLINED PLANE, A TRAY WITH AN EXTENSION AND SIDE RACKS, RELATED RACK LIFTING MEANS AND SUPPORT AND LIFTING LEGS

FIELD OF THE INVENTION

The present invention relates to the transfer of tubular elements, that is sections of tubes, pipes or tubing used in oil or mining equipment during exploration, drilling, "work over" (process to carry out major maintenance or repair treatment of an oil well) or "pulling" (oil tools recovery or removal operations in an oil well). Tubes used during the operations are arranged horizontally and must be one by one set in the area of work to be afterwards lifted vertically to be used. This transfer from the horizontal to the vertical position is one of the most dangerous and time consuming operations. The use of automatic equipment is one of the most effective solutions to increase the speed of the equipment as well as to decrease the accident index.

BACKGROUND

Tube handling apparatuses are mentioned in patents from the 60s and differ in certain aspects but in general all maintain the same basic configuration. Among the numerous documents in this field, we can mention the following background art: AR037630 A1; U.S. Pat. Nos. 3,315,822; 4,236,861; 4,371,302; 4,474,520; 4,486,137; 4,822,230; 5,127,790; 5,451,129; 5,458,454; US 2003-0147726; U.S. Pat. Nos. 6,705,414; 6,860,694; 7,021,880; WO 2004-092533 A1; US 2007-0031215; U.S. Pat. No. 7,431,550; US 2008-0253866; US 2008-0263990; US 2009-0056932; U.S. Pat. Nos. 7,552,775 and 7,568,533.

They are all formed by a catwalk or main structure located in front of the work table of the equipment and mediated by an inclined plane that may or not be an integral part of the tubular pipe handling apparatus. At the sides of this structure perpendicularly to the longitudinal axis of the same there are arranged racks used to accumulate the tubes removed from the well or vice versa. This basic arrangement does not differ from equipments hereinafter named "conventional" wherein tubes are handled from the catwalk by wires attached to them and conducted by means of hoists or winches from the work table.

The introduction of aids when lifting pipes began with a simple push skid in a trough located on the catwalk that facilitated push from or toward the inclined plane positioning the pipe at the end of the work table of the equipment.

Patents as U.S. Pat. No. 3,143,221 to Blackmon mention this kind of skid used that ends up being incorporated into all subsequent versions of the pipe handling apparatus. Even today many apparatuses still use this simple push configuration, which does not cover all the expectations as it is not able to place the tube close enough to the wellhead, frequently located a long distance from the end of the work table. Moreover, the angle of the inclined plane does not helps also to the proper disposition of the tube as a longer travel of the skid would make the end of the tube override the operator, making him difficult to couple the tube to the elevator of the service equipment rig (hereinafter so called for drilling, work over, pulling, mining or similar equipment).

This difficulty was later solved by including an additional tray that could move with the tube placed on a trough included in the same, which in turn was arranged within a cavity in the main structure or catwalk. This trough allowed the vertical movement and tilting to facilitate placement of the tube proximate end at a height about the hips of the operator and approximately 50 cm away from the wellhead center. Several patents illustrate this configuration with various degrees of both constructive and operational complexity.

The present description in the U.S. Pat. No. 3,169,645 to Freeman shows a primitive design wherein the entire top surface is lifted by a plurality of hydraulic cylinders. This configuration is very limited as to the lifting capacity and cannot cover apparatuses with high work tables (hereinafter called substructures). Later inventions such as U.S. Pat. No. 3,792,783 to Brown evolved to allow lifting only one side of the tray tilting the end near the substructure. This same kind of configuration can be found in most modern patents as U.S. Pat. No. 7,568,533 to Felt. The problem of these configurations lies in limiting the height of the substructure. While the angle of attack of the tubes from the work floor is obviously better than with an inclined plane, it is not possible yet to bring the end of the pipe closer to the wellhead center without achieving great reach heights for the operator in substructures of large dimensions.

The development and improvement of tilting and lifting of trays were obtained through the incorporation of arms and joints that not only allow an inclination and elevation but also a horizontal shift to the wellhead center, improving the approach but additionally complicating construction and operation. These solutions can be found in U.S. Pat. No. 4,380,297 to Frias and U.S. Pat. No. 4,386,883 to Hogan, the latter sets trends in this kind of tray with articulated arms used in current models. These arms allow additional flexibility when positioning and approaching the transport tray to the substructure. This kind of arms are disclosed in patents such as U.S. Pat. No. 4,494,899 to Hoang, U.S. Pat. No. 6,079,925 to Morgan and more modern patents such as U.S. Pat. No. 6,877,942 to Eastcott, U.S. Pat. No. 6,899,510 to Morelli, or U.S. Pat. No. 7,163,367 to Handley.

While strongly improving the approach and flexibility in different substructures, the problem is that the inclined plane is not a completely disposable item and should be used for other maneuvers such as lifting of additional components (bits, Top-Drives (top drive systems, such as a hydraulic or electric engine suspended from the mast of a drilling platform, which rotates the drill, the string and a drilling bit and used in the drilling process), etc.) without using complex cranes or other lifting equipment. Moreover, in case of failure of the tube lifting equipment, the operation should still be possible by means of conventional methods. In this way the pipe handling apparatus should be able to be adapted to inclined planes existing in the service equipment, or should include an inclined plane to adapt to any service equipment in a flexible manner. Moreover, another problem of including arms and hinges is the rigidity loss of the system, that is more evident when lifting in high substructures (above 6 meters) and large tubular elements such as collars or "heavy-weights" (heavy drill rods; thick wall exploration tubes used in the bottom of a drilling string), that can exceed 3 metric tons. These systems operate under full load as an inverted pendulum, being inherently unstable, and making large swinging movements that affect the life and structural capacity of the equipment. This behavior is increased in systems like those found in U.S. Pat. Nos. 4,386,883 or 4,494,899 with the tray articulated rear arm (distal side of the substructure).

A different solution can be found in U.S. Pat. No. 4,403,898 to Thompson wherein the carrier tube tray slides directly on an inclined plane included in the pipe handling apparatus. This inclined plane has an element to push the tray along a guide included in the same, displacing it to the work table. Once at the highest position the tray has another tray incorporated to extend its length and bring the end of the pipe closer to the wellhead center. It is important to note that at the same time one arm in the distal part of the tray can raise this end to reduce the angle thereof relative to the substructure. Other variants of the same kind of solution can be found in U.S. Pat. No. 7,404,697 to Thompson, US application 2009/0053013 to Maltby and U.S. Pat. No. 7,832,974 to Fikoswki. Another similar solution but with the tray included in the inclined plane can be found in US application US 2010/0068006 to Littlewood, wherein the initial movement of the tube is produced by a simple push carriage so that once the tube is located in the tray, the tray is rotated on the top of the inclined plane, advancing it and then the tube is pushed forward. All these solutions suffer from the problem of motion complexity, which must be coordinated by a PLC system (acronym of "Programmable Logic Controller") to prevent non programmed movements to happen in order to avoid collisions between components. This adds complexity, cost and maintenance requirements to the apparatus, and involves training the operators to use the same. On the other hand, one of the design problems found in the equipments with embedded inclined plane is the elevation of the same (rig up), as it must start from the horizontal position to then attain a rotation angle of up to 150°. This movement is hampered by the weight of the plane itself that is greater than that of a conventional plane due to the addition of pipe handling driving and motion systems.

Alignment is one of the critical factors on articulated equipments, as it should always correctly be aligned with the wellhead center. This is complex to be achieved during assembly (rig up) of the equipment as references are not accurate. On the other hand, the operational motion and the aforementioned pendulum effect cause significant loads on the ground that may sink causing changes in the alignment defaults. This is evident during heavy rain or soft grounds that cause inevitable positioning changes. This factor is not as incident with inclined plane including equipment, since once aligned they are inherently less susceptible to changes. It is important to note that on articulated equipment, any change of position to the floor height is amplified by the distance of the arms, and that this is not the case with apparatuses with inclined plane.

None of the previous inventions provide a mechanism to raise the tubular pipe handling apparatus for transportation autonomously from the ground level to the height of the transportation means. This is of vital importance because otherwise cranes must be available in order to place the equipment on trailers for transportation. Conventionally trucks with hoists or winches called "oil trucks" are used, but they lack of ductility as the great length of this tube handling apparatuses complicates handling and placement on trailers.

In all the patents found, the derailment means of the trays used to remove sideways the tubes are operated remotely but are an inner integral part of the tray, and should have some sort of logic to not be triggered accidentally during the raising or lowering of tubes from or toward the wellhead. This complicates the system and operation by the operators.

The common method of construction of apparatuses is through welded tubular latticed structures. These structures end up being very rigid and susceptible to the appearance of cracks and breakage during operation.

Therefore, it is necessary to design an improved, height adjustable, portable tubular pipe handling apparatus as well as the corresponding operation methods, as defined in the present invention.

SUMMARY OF THE INVENTION

The object of the present invention is a tubular pipe handling apparatus, consisting of a chassis, an inclined plane, a tray with an extension and side racks, that comprises: a tube lifting tray with an extension on its end, detachable and capable of rotating to reach the wellhead center, wherein said tray is actuated from its rear portion and pushed to be transferred when supported by the inclined plane; at least a pair of racks on one side of the apparatus having a hinge system with pin block on the hinge or self-lock to perfectly align and lock at 90 degrees, being the assembly bolted to the main body of the chassis; a rack lifting means that inclines the rack and also transfers tubes from and outwardly from the rack independently to storage racks or pipe baskets; an inclined plane, which total length is adjustable by means of extensions to accommodate the required operation height of the substructure, with extensions that are assembled with each other with threaded fasteners and having a centering pin; and four support and lifting legs included in the chassis that elevate the apparatus to place it on a trailer for transport.

Particularly, said tray extension comprises a hinge allowing moving from the support position on the inclined plane to a position aligned with the tray continuing its geometry and allowing bringing the tray close to the wellhead center.

More specifically, tray extension is detachable and replaceable by other extension to adapt the tray to the geometry required by the worktable.

Preferably, the tray extension has on the hinge a plurality of slots with plates that follow the relative movement of the extension relative to the tray, allowing a gradual transition of the geometry of the trough between the body of the tray and the extension thereof.

More preferably, said plates have a pivotal point at one of their ends and a support point that allow displacing with the movement.

Preferably, the tray extension allows the pipe handling apparatus to work as a conventional catwalk when the tray is not active.

Preferably, said tray extension is positioned relative to the tray body by an adjustable geometric stop.

In a preferred form, the rack is assembled with threaded fasteners to the chassis through a quick configuration change support allowing to substitute the mounted rack by other rack of different length or to remove the preload rack to place the rack head directly on the chassis body.

In a more preferred form, said rack support is at the same time a leveling leg ensuring the correct leveling of the equipment and racks.

Additionally, said rack lifting means comprises: a hydraulic, electro hydraulic or electromechanical cylinder driving system that allows tilting the rack or handling the tube lifting means.

Furthermore, said inclined plane comprises: a driving system to move from the transport position to operative position through a set of connecting rods and eccentric fork with an angle of rotation of 150 degrees in a single operation and with only one actuator, an eccentric fork and a bridge connecting rod to the inclined plane body, which rotation points are on an anchor ear and the geometry amplifies the linear movement of the actuator to a rotary movement;

wherein said anchor ear is bolted to the chassis on an extension thereof that raises the same relative to the chassis rails.

Furthermore, the tray is actuated by pushing from the rear, so the tray front support over the inclined plane allows sliding towards the work floor.

Preferably, the tray is actuated by a push system comprised of a hydraulic cylinder, or an electromechanical or electro-hydraulic actuator, with magnified displacement by a wire, belt or chain system and set of pulleys, and that moves longitudinally on the same rear support guide of the tray.

More preferably, the push system can be replaced by a drum system with wire, winch or hoist that anchors its wire on the rear portion of the tray and when winding or unwinding moves the tray.

Still more preferably, the winch can be actuated by a hydraulic motor, an electric motor or a thermal engine.

In a preferred form, the body of the legs has a cylindrical body of rectangular or circular section and vertically aligned with a telescopic inner body actuated by a hydraulic lifting cylinder, electromechanical or electro hydraulic actuator, and is used to vertically lift the equipment.

Also preferably, said legs are detachable by connection to the chassis by threaded fasteners, such as screws, bolts or pins.

In a preferred form, also, said leg lifting cylinder is coupled to the telescopic inner body through a slot in the rod inserted on one end and is retained by a set screw acting as a lock, wherein said end rests on the detachable support plate that is in contact with the floor and said end is coupled to the telescopic body through a flanged joint.

Preferably, legs are retractile in the plant view so as to position longitudinally to the equipment to allow operational work or during transportation and can be rotated and opened 90 degrees to the longitudinal axis of the equipment during the operation of lifting.

More preferably, positioning is done manually or is driven by means of hydraulic, electro hydraulic or electromechanical actuators.

Furthermore, the telescopic body of the leg and the main body of the leg make contact through sliding plates positioned in cavities on each body.

Also, lifting legs can be fully retracted with a lower final height through rotation about a pivotal point located at the end of the equipment arm allowing retraction under work floor, wherein driving is performed by means of a hydraulic cylinder, electromechanical or electro hydraulic actuator that rotates the leg in the position of the open arms.

Additionally, lifting legs can be fully retracted with a lower final height through rotation about a pivotal point located at the inner end of the arm of the leg, allowing self-locking retraction within the arm, wherein driving is performed by means of a hydraulic cylinder, electromechanical or electro hydraulic actuator that rotates the leg in the position of the open arms.

Furthermore, the tray is comprised by: a main body formed by two beams with a C-shaped cross section, with inner ribs and cross members; a V-shaped trough for housing the tubes, separated from the beams by two side slots, which serve as guides and a connection cavity of the carriage with driving system; and a set of derailment means located in the main body of the tray.

Additionally, the driving system is inside the tray, and is driven by pulleys and wires or chains that move inside and in duplicate.

Furthermore, the wire pull is conducted through two drums wherein a few turns are wound, meeting these drums on a common axis and being driven by a dual system of pinion, sprocket and chain or an orthogonal gearbox system.

Preferably, the set of derailment means is driven externally to the tray by linear actuators mounted in the equipment chassis acting on the tray mechanism only at the rest position.

Also preferably, the set of derailment means is actuated through a shaft and a slotted body that rotates and displaces the derailment means.

Furthermore, the set of derailment means comprises four derailment members.

Furthermore, the equipment chassis is a structure that comprises beams and frames connected by threaded elements.

It is another object of the invention to provide a rack lifting means that comprises: a hydraulic, electro hydraulic or electromechanical cylinder driving system that allows tilting the rack or driving the tube lifting means.

Preferably, the rack lifting means is assembled with threaded fasteners to the chassis through a quick configuration change support allowing substituting the mounted rack by another rack of a different length or removing the preload rack to place the rack head directly on the chassis body.

More preferably, said rack support is at the same time a leveling leg that ensures correct leveling of the equipment and racks.

In a preferred form, the rack lifting means is incorporated to tube load and unload apparatuses or pipe baskets.

It is another object of the present invention to provide support and lifting legs wherein their body is cylindrical of rectangular or circular section and vertically aligned with a telescopic inner body actuated by a hydraulic lifting cylinder, electromechanical or electro hydraulic actuator used to raise vertically the equipment.

Preferably, support and lifting legs are detachable by connection to the chassis through threaded fasteners, such as screws, bolts or pins.

In a preferred form, the lifting cylinder is coupled to a telescopic inner body through a slot in the rod inserted on one end and is retained by a set screw acting as a lock, wherein said end rests on a detachable support plate that is in contact with the floor and said end is coupled to the telescopic body through a flanged joint.

Furthermore, support and lifting legs are retractile in the plant view so as to position longitudinally to the equipment to allow operational work or during transportation and can be rotated and opened 90 degrees to the longitudinal axis of the equipment during the operation of lifting.

Preferably, positioning of support and lifting legs is done manually or is driven by means of hydraulic, electro hydraulic or electromechanical actuators.

Additionally, the telescopic body of the leg and the main body of the leg make contact through sliding plates positioned in cavities on each body.

Preferably, support and lifting legs are fully retracted with a lower final height through rotation about a pivotal point located at the end of the equipment arm allowing retraction under work floor, wherein driving is performed by means of a hydraulic cylinder, electromechanical or electro hydraulic actuator that rotates the leg in the position of the open arms.

Also preferably, support and lifting legs are fully retracted with a lower final height through rotation about a pivotal point located at the inner end of the arm of the leg, allowing self-locking retraction within the arm, wherein driving is performed by means of a hydraulic cylinder, electromechanical or electro hydraulic actuator that rotates the leg in the position of the open arms.

In a preferred form, support and lifting legs are included in apparatuses that need transportation such as pipe baskets, containers, operator rooms or any other skid mounted unit that must be transported by all kinds of trailers or the like.

DETAILED DESCRIPTION OF THE INVENTION

Figure 1:
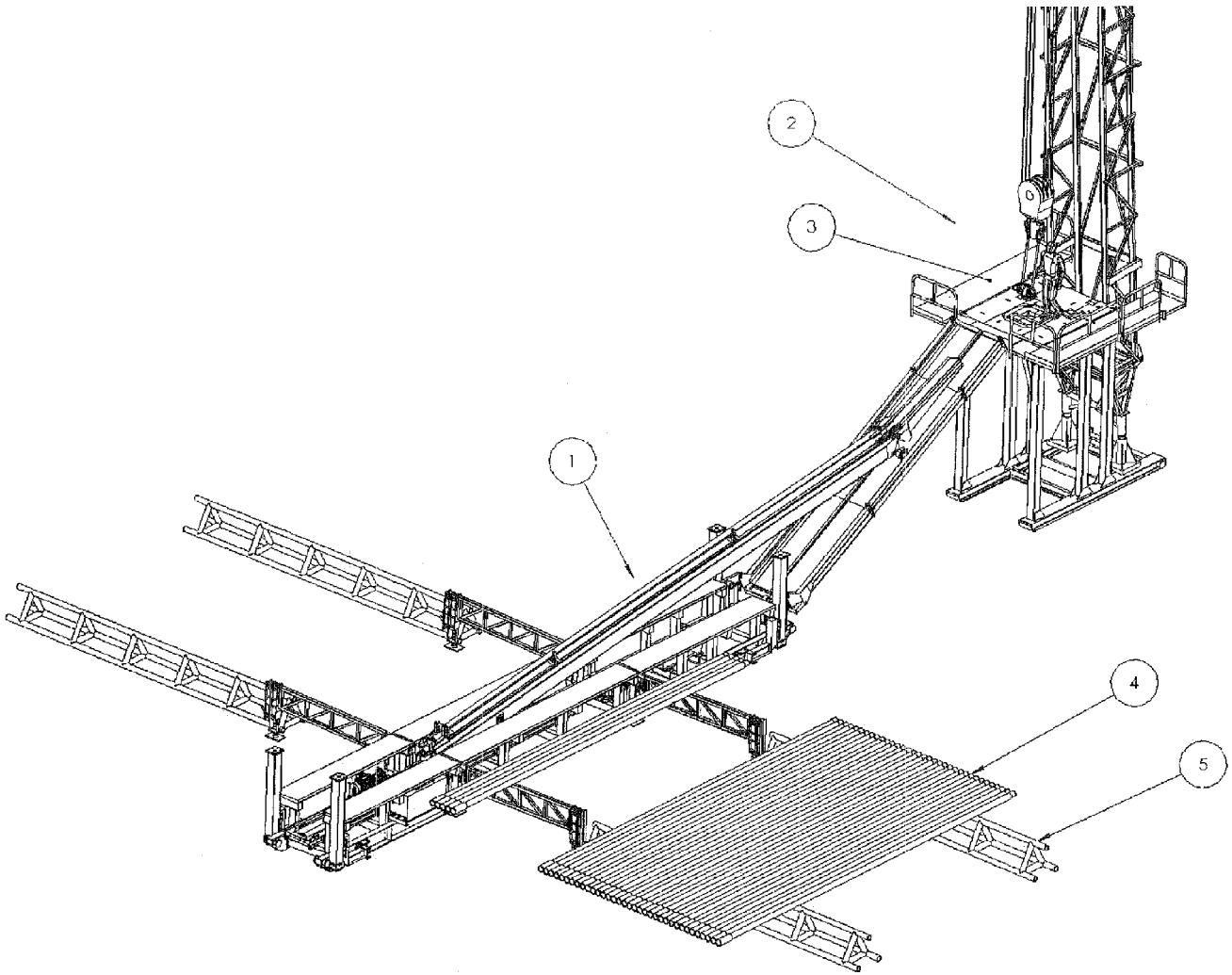
FIG. 1 shows a preferred embodiment of the entire tubular pipe handling apparatus of the present invention, in working position mounted on service equipment.

FIG. 1 shows a description of the equipment assembled in a standard configuration at an oil well. The tubular pipe handling apparatus 1 is longitudinally disposed towards the service equipment 2 located on the wellhead. This service equipment 2 is comprised by a substructure, work table or work surface 3 wherein transfer of tubes with the help of operators is performed. This surface is elevated from the level of the ground at a variable height depending on the service equipment used for insertion or removal of the tubular body from the well.

Tubes 4 are normally located horizontally on stationary racks or storage racks 5 located at the sides of the catwalk or tubular pipe handling apparatus 1. These racks accommodate all tubes to be transferred from or to the work surface and are an integral part of the service equipment, being used with conventional catwalks. The purpose of the tubular pipe handling apparatus is to facilitate the transfer of pipes from the horizontal position of storage in these racks to its location at the wellhead center on the work surface to be later handled by operators.

Figure 2:
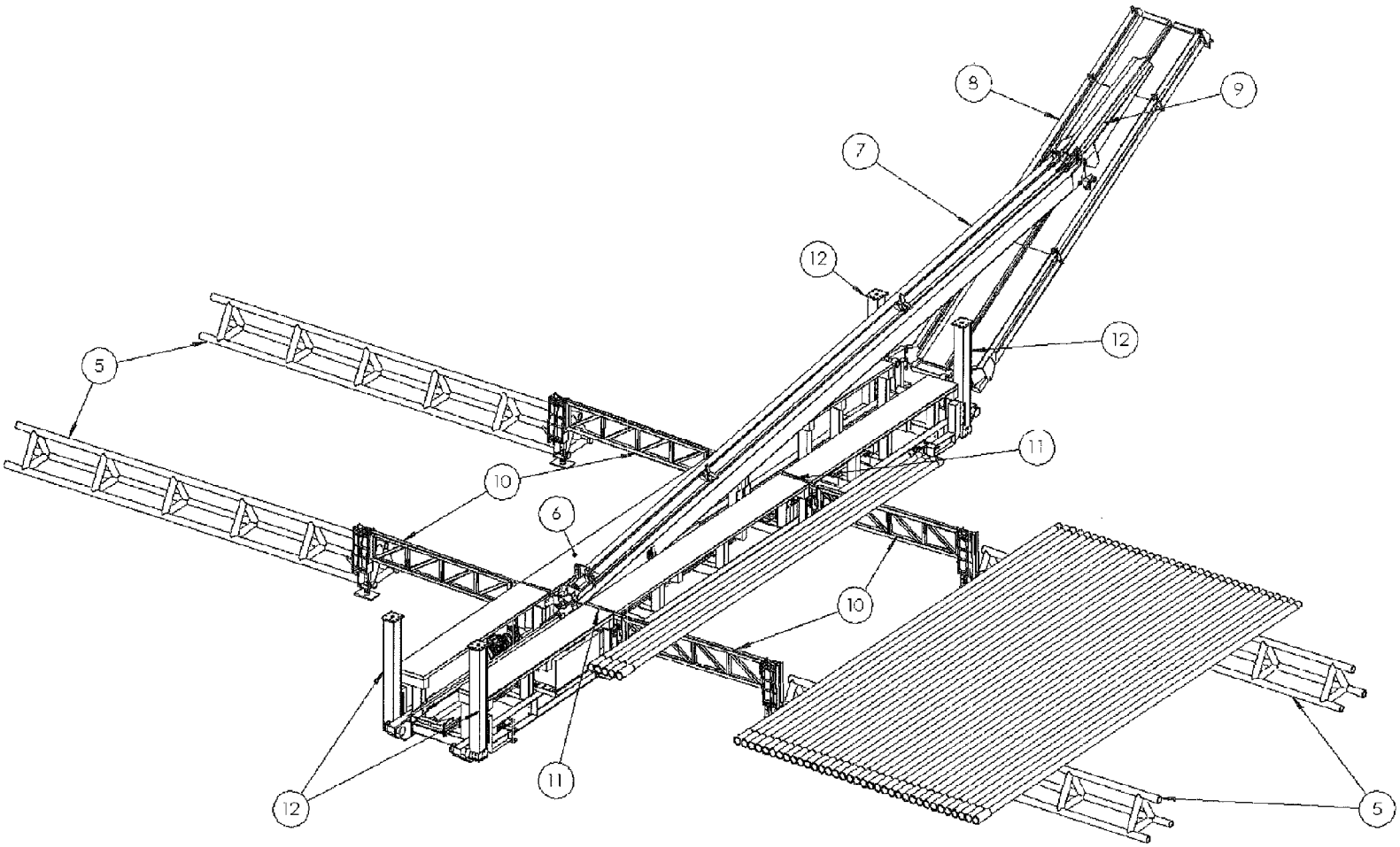
FIG. 2 lists the main components of the entire equipment in working position.

FIG. 2 shows a description of the tubular pipe handling apparatus 1 presented in working position. The so called "equipment" is comprised by a main supporting structure 6 or chassis wherein there is a cavity where the tube transference tray 7 is accommodated. The latter can move supported by an inclined plane 8 from its horizontal position fully contained within the supporting chassis and leveled on its upper surface with the chassis floor to a position on the distal end of the inclined plane. The tray 7 has on its end an articulated extension 9 that extends the tray to the wellhead center.

The storage racks 5 are located crosswise to the longitudinal axis of the equipment and primarily store the tubes. These racks can also be replaced normally in service equipments by pipe baskets, having a similar purpose. Two pairs of preload racks 10 are located between the main body of the equipment 6 and the storage racks 5. These are linked to the main body 6 and are integral with the tubular pipe handling apparatus 1. These preload racks serve as an inclined plane to load or unload tubes by rolling from or to the tray. Two indexer elements 11 at each side allow loading one tube at a time to the tray.

The same figure shows on each distal end of the equipment body 6 a pair of retractable lifting legs 12 that allow loading the equipment by lifting and placing a trailer underneath to be later transported.

Figure 3:
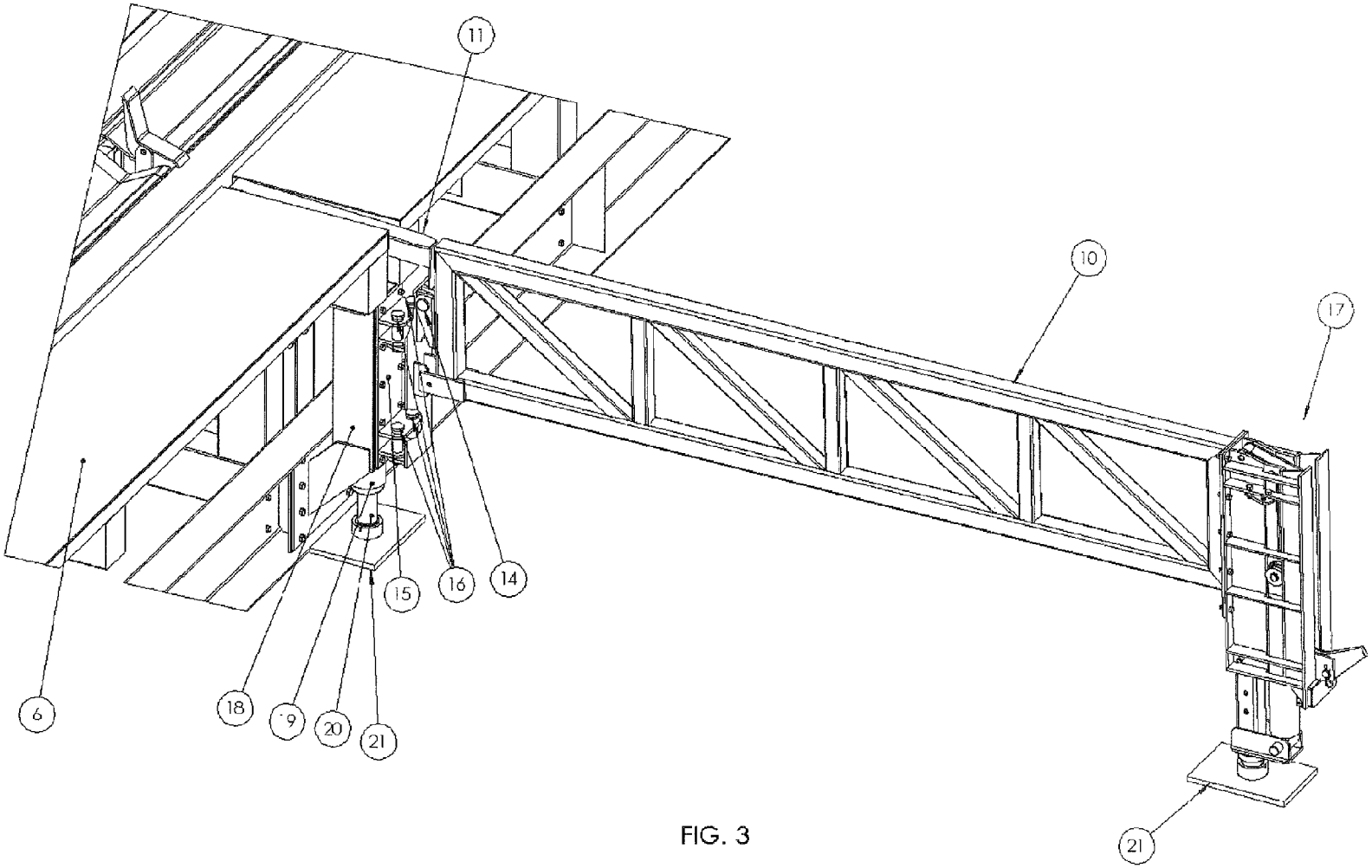
FIG. 3 enlarges the area of one of the tube preload racks and identifies the components comprising the same.

FIG. 3 illustrates in detail the preload rack 10 zone. On the upper portion of its main body tubular bodies are supported and it is capable of being tilted towards the main body of the equipment 6 or in the opposite direction to insert or remove tubes. The main body of the preload rack 10 is coupled to the chassis by means of a hinge system 15 where it can oscillate laterally and in the vertical plane. The ear with pin 14 allows tilting in the plane perpendicular to the longitudinal symmetry plane of the equipment, and this action is performed by the rack head 17. At the same time there is another set of hinges with pins 16 to retract or rotate the preload rack to a position aligned with the main body to facilitate equipment transport. This set of pins 16 allows that when removing one of them the other pin works as a hinge or as a rotation center. On the other hand, having two pins installed the position obtained is accurately at 90 degrees to the longitudinal plane of the equipment.

The set of hinges 15 is attached to the equipment chassis through the rack support 18 by threaded joints such as screws or bolts that are easily removable or replaceable if necessary. This allows placing the rack head assembly 17 directly on the support 18 in case the complete preload rack is not required. This is the case when the location or work place is limited or when another kind of tube storage system is used.

The rack support 18 is also attached by means of threaded elements such as screws or bolts to the main body of the equipment 6. The support is not only a coupling means to the main body but also serves as a leveling means of the equipment. An annular body with inner threads 19 comprises a threaded rod 20 inside that through its variable length allows placing the equipment directly on a support surface 21. This system allows that the equipment and rack system are correctly leveled. This last option of threaded rod and body can also be replaced by a hydraulic cylinder, electromechanical or electro hydraulic actuator.

Figure 4:
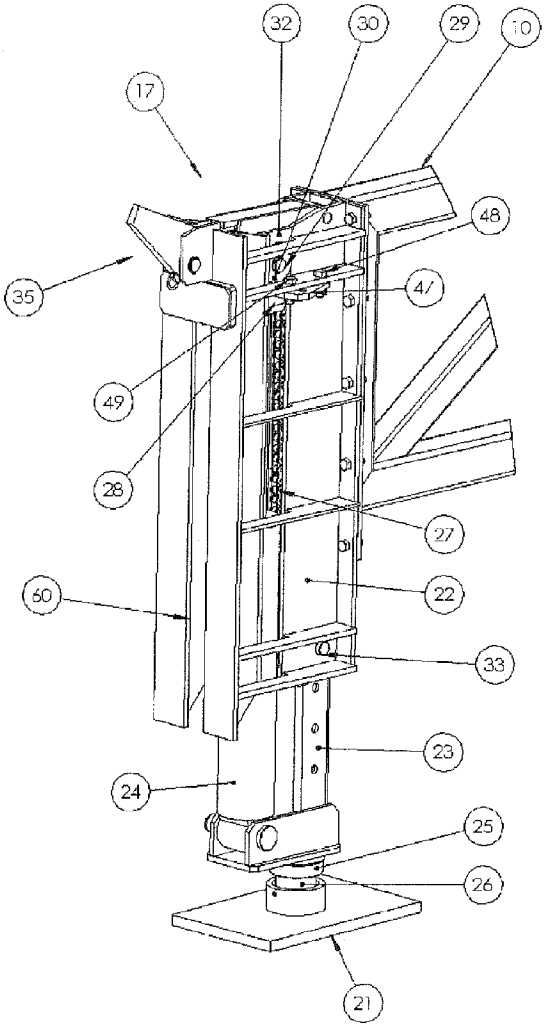
FIG. 4 is the enlarged area of the end of the preload rack showing the tube lifting means.
Figure 5:
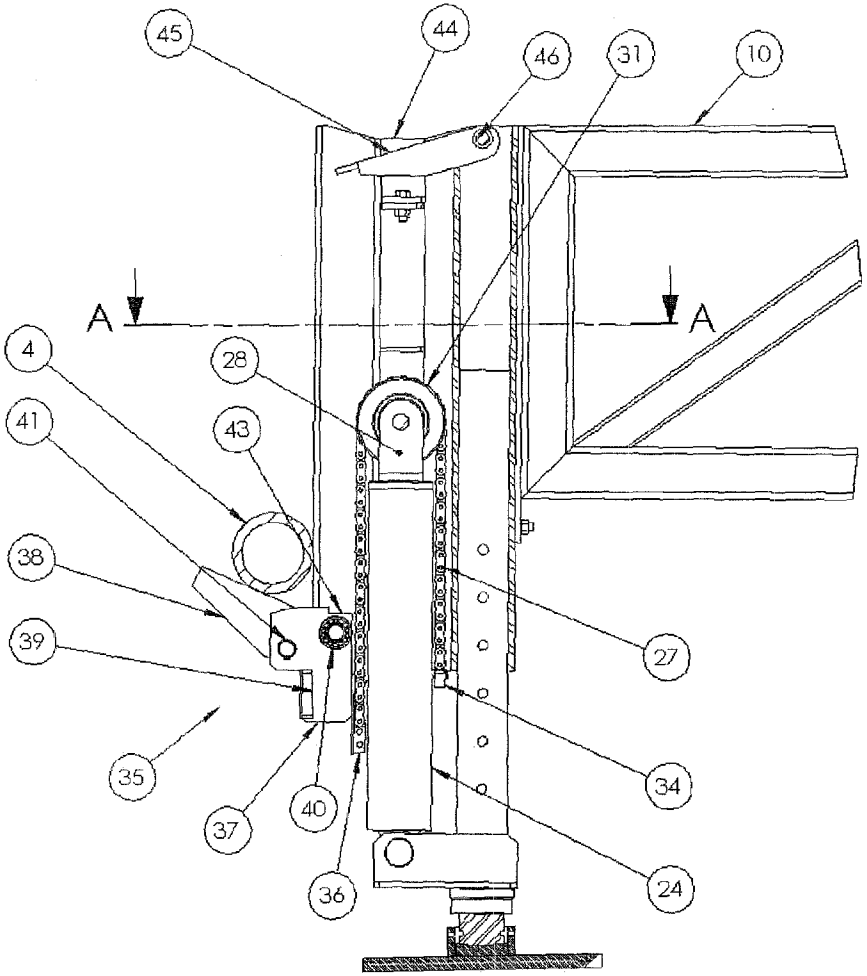
FIG. 5 is a cutaway view of the lifting means showing the components comprising the same.
Figure 6:
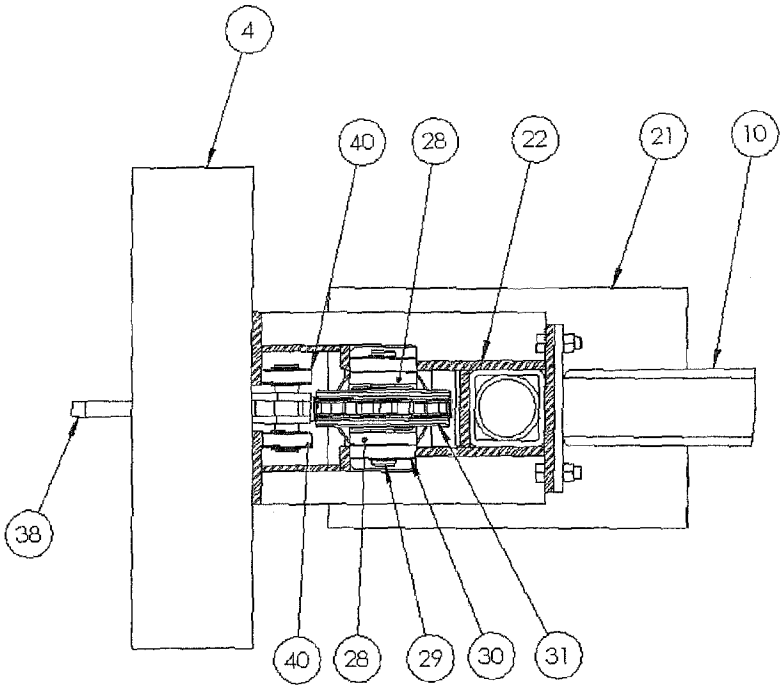
FIG. 6 shows a cutaway upper view of FIG. 5.

FIG. 4, FIG. 5 and FIG. 6 show in more detail the rack head 17. FIG. 4 shows an isometric view of the rack head while FIG. 5 shows a cutaway side view showing the inner components. FIG. 6 shows a cross section plan view.

The rack head 17 serves two primary functions. One function is to give the correct inclination to the body of the preload rack 10 to allow the tubes supported on the same to move toward or from the equipment allowing loading or unloading respectively. On the other hand it also allows loading or unloading from or to the storage racks 5 or pipe basket or the like. The rack head 17 is comprised by a main body 22 having inside a hydraulic cylinder 24 (or electro-hydraulic or electromechanical actuator) anchored in its lower portion to a leg 23. This leg 23 has on a lower portion a fine adjustment by a threaded joint wherein a stem 26 is introduced into the threaded body 25. This stem 26 rests on the support surface 21 which lies on the ground. The hydraulic cylinder 24 comprises on the upper end a clevis shaped ear 28 that through shafts 29 keeps inside a chain guide 31 and on their outer surfaces two guide wheels 30. The guide wheels allow the correct displacement of the cylinder on the vertical openings in the body of the lifting means 22. Initially, the body of the rack 10 is tilted by means of the extension of the cylinder 24 to allow the end of the guide wheel 30 contacts on the top of the path 32. Upon completion of the contact the cylinder extends allowing the lower end to displace the body of the leg 23 on the inner guide of the main body 22 which contains it. This causes the body of the rack 10 to move to achieve the desired position. This position is kept by means of the bolt 33 that blocks through the adjustment opening on the body 22 and level openings on the leg 23. The tilting fine adjustment is set by the threaded stem 26. Having attained a fixed tilting position for the rack body 10, tubes can be loaded or unloaded from or to the storage racks 5. To this end the cylinder 24 is actuated, that is attached by a lower portion through a pin 33. The cylinder 24 action allows then to displace the chain guide 31 that contains the lifting chain 27. The chain 27 is attached on one end to the anchor 34 which is in turn secured to the body of the lifting means 22, while its other end is secured to anchor 36 of the tube lifting assembly 35. This tube lifting assembly 35 is displaced by the chain 27 at a ratio that is twice the displacement performed by the cylinder 24. The tube lifting assembly 35 moves through the cavity 60 of the lifting means body 22 which serves as a guide for this purpose, where it is supported on an inner upper portion by a pair of bearings 40 and on a lower outer portion by a pair of wear plates 39. Both positions 39 and 40 can be replaced by another kind of lineal guidance system. The tube lifting means 38 is then used as housing for the tube 4 by means of cradle geometry and allows containing the tube when raised. This tube lifting means 38 is assembled to the body of tube lifting means 37 by a system of bolt 41 or the like to facilitate their immediate replacement to conform to different geometries of tubes.

Figure 7:
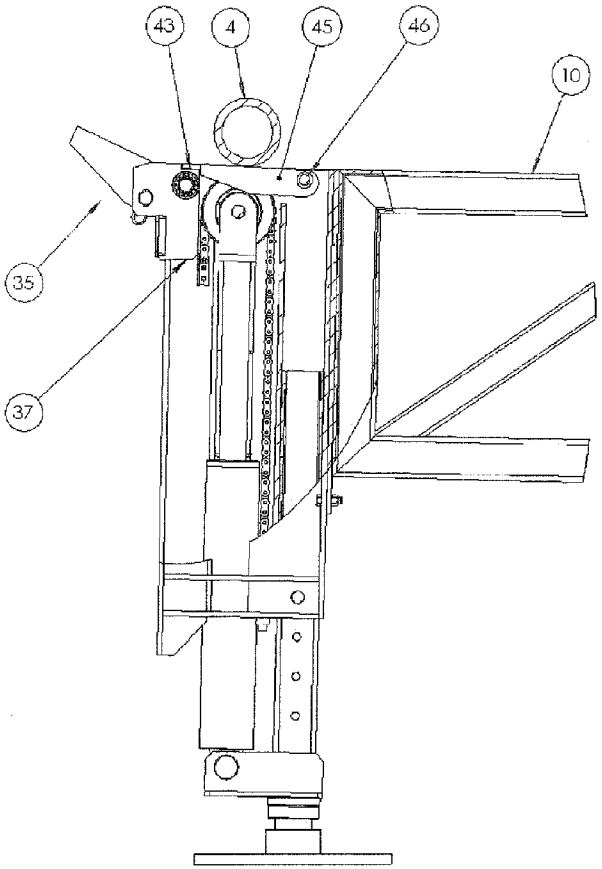
FIG. 7 is a side view of the lifting means indicating the position of the components thereof with the lifting means in the highest position.

FIG. 7 shows the lifting means assembly with the lifting means at the uppermost position, wherein actuation during loading of tubes to the preload rack 10 can be seen. The tube lifting means body 37 has on its upper portion a stop housing 43 that once in contact with the bridge 45 drags it pivoting on the bridge axis 46 to fully cover the cavity 44 provided in the body of the lifting means 22. This allows the tube 4 to overcome this cavity and get the preload rack 10. The cavity 44 is configured for unloading the tubes from the preload rack 10 to the storage rack 5. This cavity acts as tube retaining element to prevent free movement and in turn as the system to collect each tube to the tube lifting means.

For the transport position of the preload rack 10, the lifting means is actuated with the cylinder 24 fully opened to reach the end of the stroke 32. In this position a transportation lock 47 is actuated pivoting on the shaft 48 and is retained by the pin 49. This lock 47 in the transport position blocks the guide wheel 30 and allows once the pin 33 is released to lift the leg 23 and in turn to unload the rack to be closed to its transport position. It is to be noted that the rack has in the set of hinges 15 a physical tilting stop than prevents the rack head 17 to contact the floor when fully closed for transportation.

Figure 8:
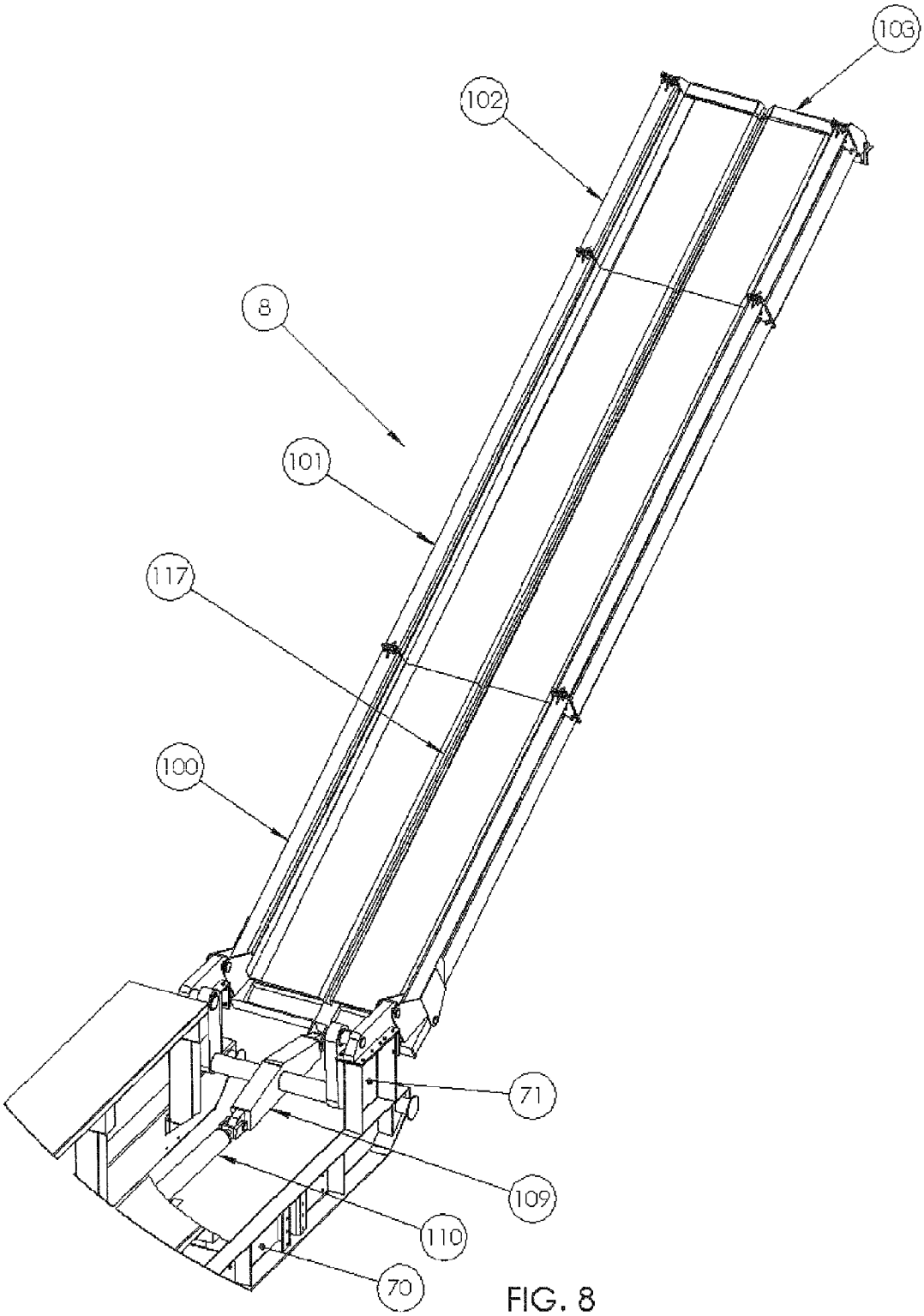
FIG. 8 is a view of the inclined plane in operative position and the components used comprising the same as well as assembly thereof to the chassis and the elements and actuators allowing moving from a transport position to an operative position.
Figure 9:
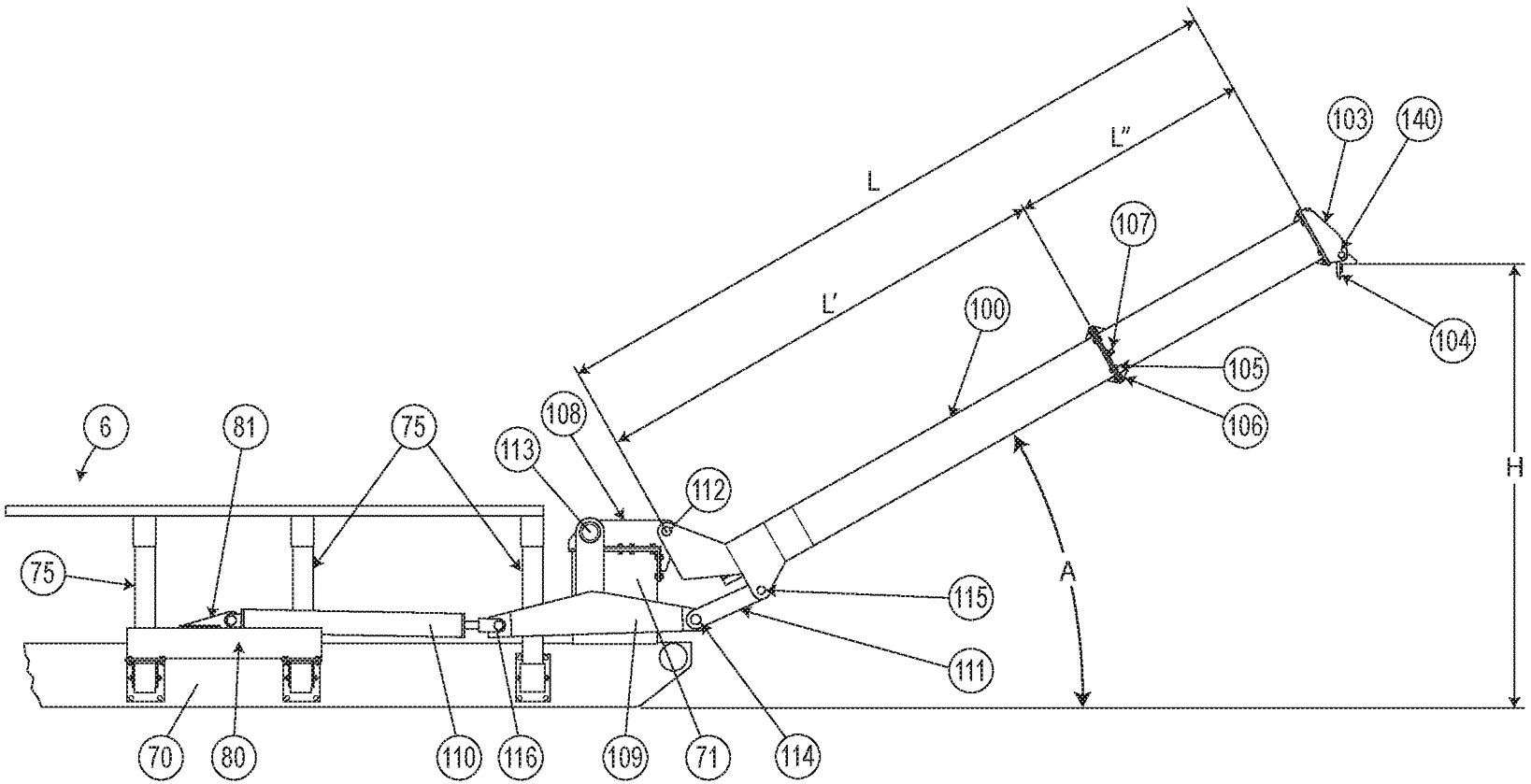
FIG. 9 is a cutaway longitudinal view of the inclined plane indicating the geometry in operative position and the elements comprising the same.

FIG. 8 and FIG. 9 show in detail the inclined plane 8 of the equipment. This is composed of a main body 100 and a plurality of extensions as those shown in the positions 101 and 102. This plurality of extensions of variable length are used to prolong the length of the plane L to the required dimension to be accommodated to the height H of the work table. The inclined plane 8 has on its main body 100 a pair of ears 112 that couple on a pair of anchor ears 108 integral with the equipment chassis 6. These couple the plane to the chassis and allow rotation so as to change the angle A to the main body 6 of the equipment. Thus for a length L of the inclined plane the angle A variation allows to accommodate different heights H of the work table. This angle A ranges operatively between 30 and 50 degrees.

The extensions are assembled between them or to the main body 100 through a binding plate 105 having a centering pin 107 which facilitates location to then be adjusted by means of threaded fasteners 106. In this way, the distal end of the main body 100, as well as both ends of the extensions, keep the same geometry of plates allowing interchange and coupling of extensions. The inclined plane 8 once assembled with the required number of extensions has on its end a support portion 103 including in its geometry the support legs 104 that rest on the work floor or substructure 3. These legs 104 pivot on a pin 140 to allow a correct support of the plane 8 relative to the floor 3.

Figure 10:
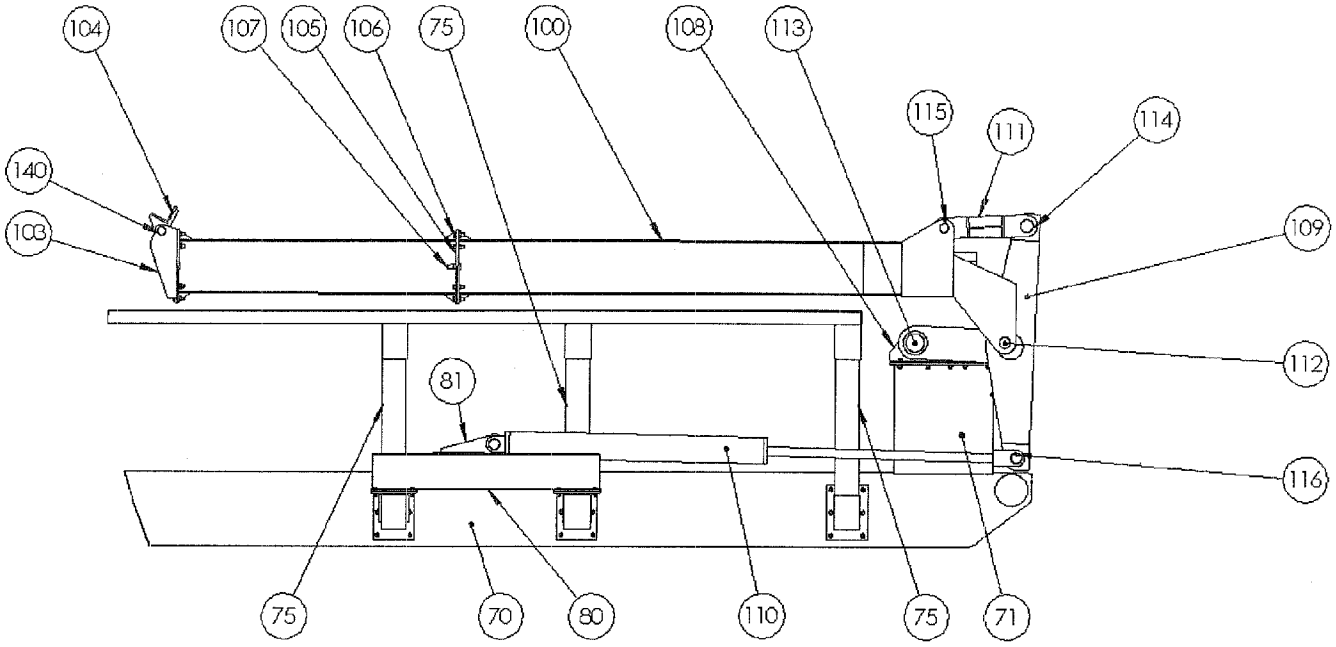
FIG. 10 is a longitudinal cutaway view of the inclined plane in the transport position.

The entire assembling of the inclined plane 8 is made in the transport position of the equipment, as shown in FIG. 10 wherein it can be seen that the components are easier to assemble than in the operative position. The transition from the transport position to the operative position is obtained through an actuator system 110 and linked bodies 109 and 111 that allow the plane to move from a horizontal position at a rotation angle up to 150 degrees (or even more) relative to the initial position in only one movement.

The actuator 110 can be comprised by a hydraulic cylinder, an electro hydraulic or electromechanical actuator and coupled to the equipment chassis through a support 80 that is at the same time coupled to the frames 75 of the equipment. This support 80 has an ear 81 where the actuator 110 engages. The benefit of this new system is that it has only one actuator and allows an angle variation much higher than existing systems. The actuator end 110 is coupled by a pin 116 to a clevis 109 which has an eccentric motion relative to the pivotal point 113. This eccentric clevis allows the tray 7 to be contained without being hampered during operation thus keeping the chassis 6 cavity. On the other hand this clevis magnifies the movement and is coupled to the main body of the inclined plane 100 through a bridge 111 and pins 114 and 115. All the movement of the clevis and plane is coupled to an anchor ear 108 that contains the rotation points 113 of the clevis 109 and the pivotal point 112 of the main body of the inclined plane 100.

It is to be noted that ear 108 is elevated relative to the chassis beam 70 by means of an integral pillar 71. Ear 108 is screwed to the pillar 71 to allow a correct alignment between both ears on each side, that is, the right and left side of the equipment, during the assembly. It must be mentioned that the inclined plane 8 has on its symmetry plane a trough 117 that serves as a guide to move the tray 7 when lifting or lowering. It can also be used in the event of not being able to operate the tray 7 due to any failure as a guide of a conventional inclined plane, i.e. to slide and guide tubes through this trough.

Figure 11:
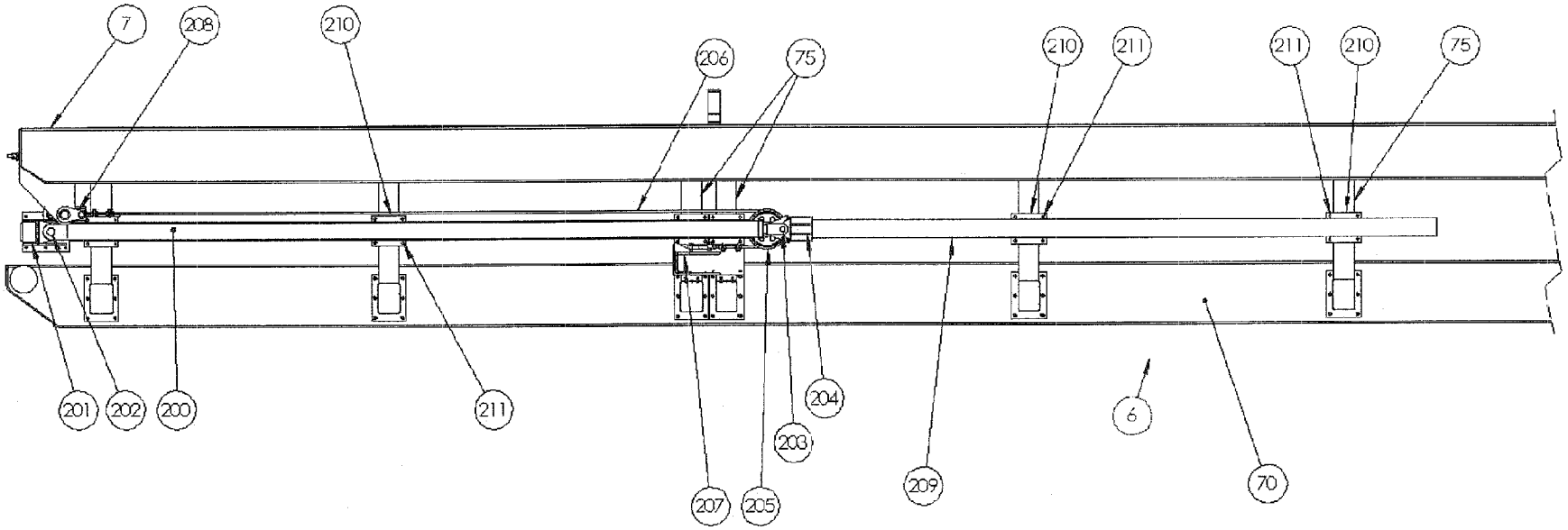
FIG. 11 is a longitudinal cutaway view of the equipment indicating the lifting actuator system of the tray.
Figure 12:
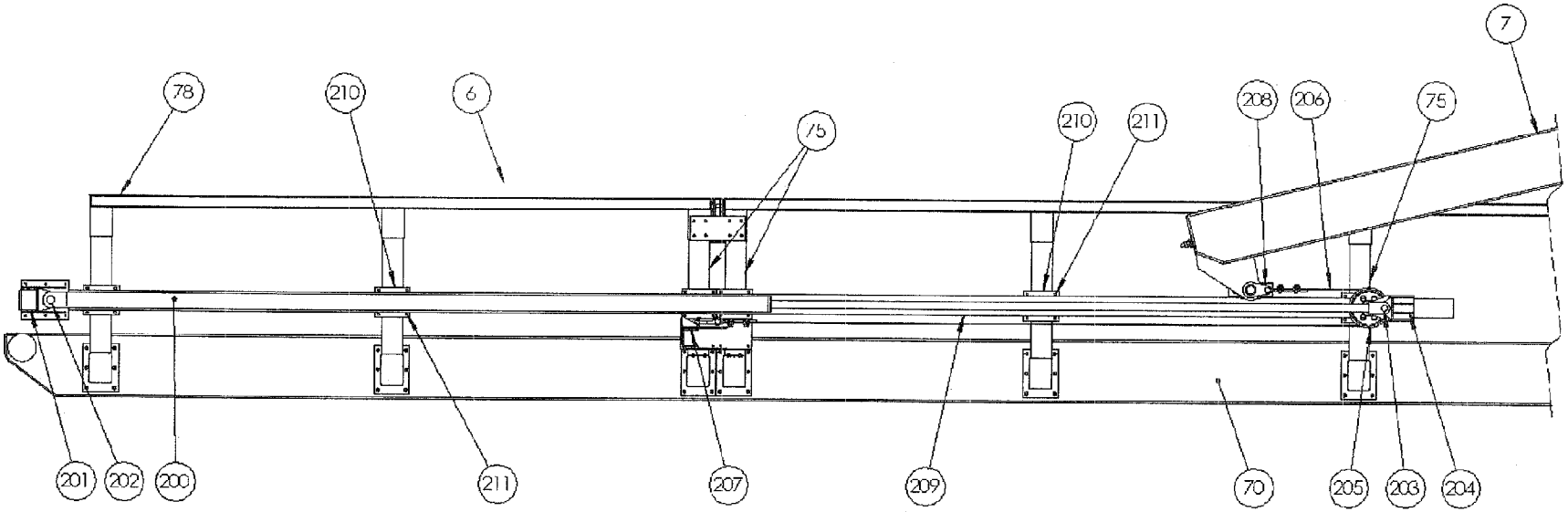
FIG. 12 is a continuation of FIG. 11 showing the tray in a lifting position, with the actuator moved.
Figure 13:
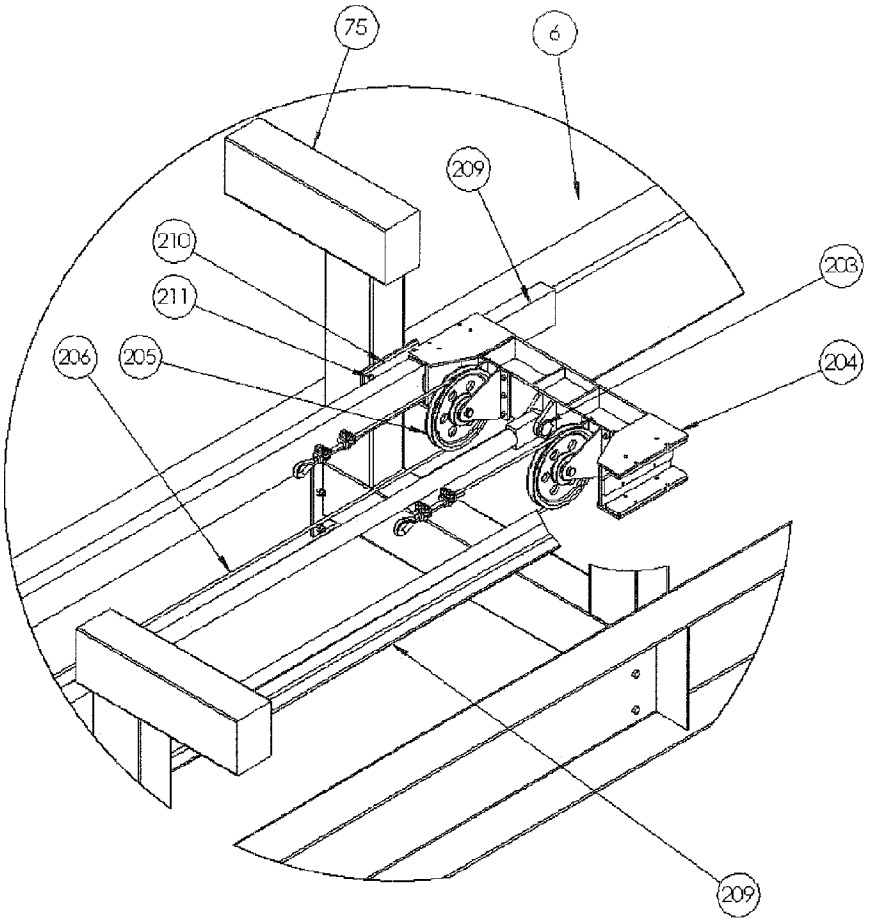
FIG. 13 is a detailed view of the set of pulleys used to actuate the tray.

FIG. 11, FIG. 12 and FIG. 13, show the mechanics and movement of the tray 7. Tray 7 is contained inside a longitudinal cavity located in the chassis 6 and is pushed from the behind. This allows a movement about the longitudinal axis of the chassis that being supported on its front end on the inclined plane 8 allows displacement rising to the work floor. Push from the rear of the tray 7 is done through a hydraulic cylinder 200 that can be replaced by an electro hydraulic or electromechanical actuator. This cylinder 200 is secured to a support 201 and it is allowed to move longitudinally along the chassis 6. The chassis 6 of the equipment is a structure composed of longitudinal beams 70 and frames 75 joined by means of threaded elements, wherein not only floor 78 is supported but guide 209 is supported, through which tray 7 slides. These guides 209 are held by joint plates 210 coupled by screws, bolts or other kinds of threaded elements 211. In this way the two guides located on both sides of the inner cavity of the chassis 6 allow the wheels of the tray 7 to be supported.

The tray 7 is pushed by the actuator 200 that upon extension pushes a bridge 204 that slides on the guide 209. The actuator is coupled to this bridge through a pin 203 and this bridge houses two pulleys 205 that support two wire ropes 206. This allows the wire rope to be coupled in one end to a fixed point in a support 207 that in turn is attached to the frames of the chassis 75 and in the other end to a terminal 208 attached to the rear portion of the tray 7. This system of pulleys allows upon displacement of the actuator 200 that the wire rope travel is duplicated thus producing a longer pushing distance of the tray 7 longitudinally on the chassis 6. It is to be noted that the wire rope 206 can be replaced by a chain or a belt for the same purpose.

It is important to note that the actuator system 200, shown in the graphic as a hydraulic actuator or an electromechanical actuator, can be replaced by a winch or drum system with wire rope that simply pushes the tray from its rear portion. The movement or longitudinal displacement of the actuator or the tray depends on the total length of the inclined plane; therefore the maximum length to displace will be selected by the operator. FIG. 13 shows in more detail the set of pulleys as well as the wires and the actuator moving and the guides 209 wherein the tray and bridge move.

The tubular pipe handling apparatus has a built-in lifting system that allows placing a trailer or chassis underneath to facilitate transportation. This simplifies transportation and an adequate positioning and alignment in the field or location. For this purpose the equipment has four legs shown in FIG. 14, FIG. 15 and FIG. 16. These four legs 12 are located on the longitudinal ends of the equipment. These legs are laterally retractile and can be extended vertically to elevate the equipment for transportation.

Figure 15:
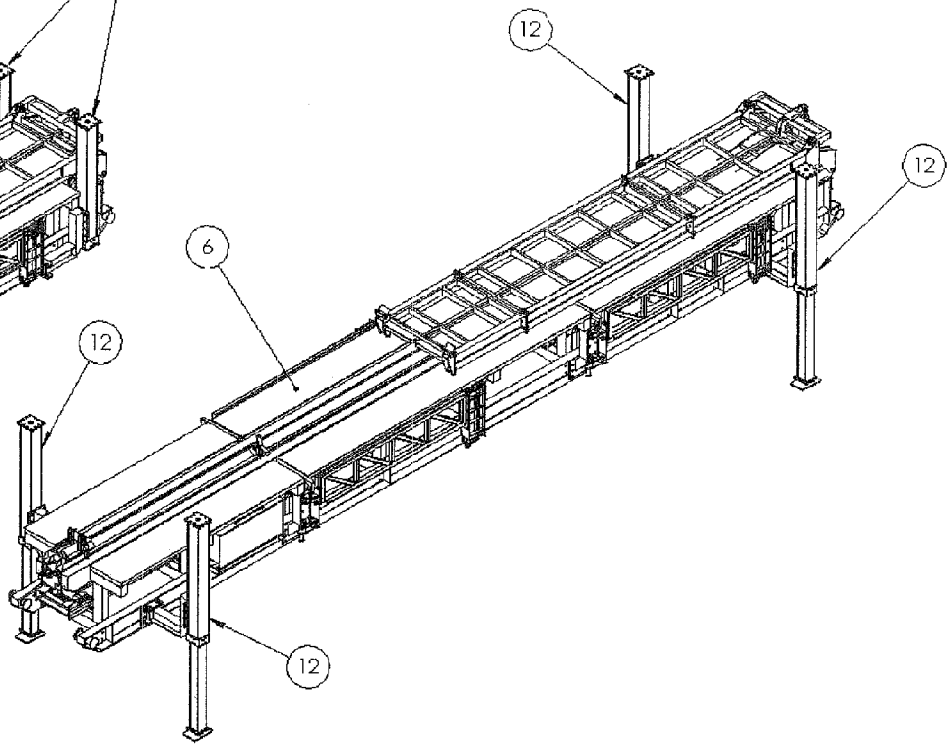
FIG. 15 shows the same view of FIG. 14, but with the lifting legs fully deployed to allow the positioning of the trailer or carriage for transportation.
Figure 14:
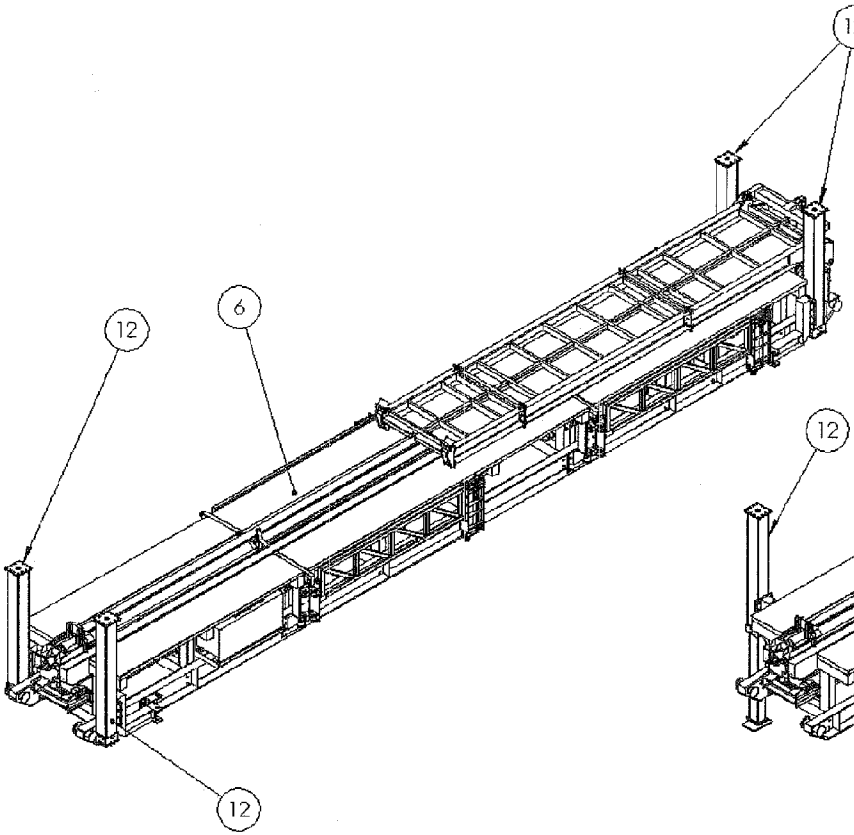
FIG. 14 is an isometric view of the entire system in the transport position.
Figure 16:
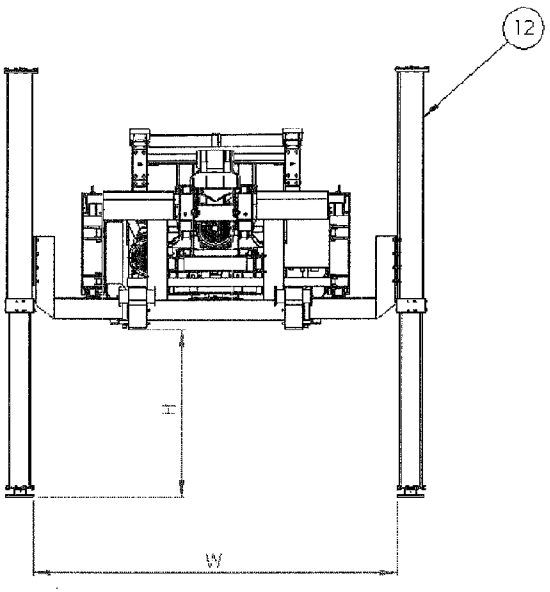
FIG. 16 is a front view of FIG. 15, showing the resulting geometry of the legs.

FIG. 14 shows the legs on the ends of the equipment closed and retracted while FIG. 15 shows the legs in the lifting position. To get this lifting position the legs are initially laterally opened, increasing the inner distance between them in the traverse direction of the equipment. Then, once locked in this position, the legs are extended vertically to raise or lift the equipment from the ground. This arrangement is better explained in FIG. 16 that shows that when legs are laterally opened and vertically extended, the equipment is lifted to a height H and with an inner width between the legs W allowing placing a trailer or any transportation means underneath.

Figure 17:
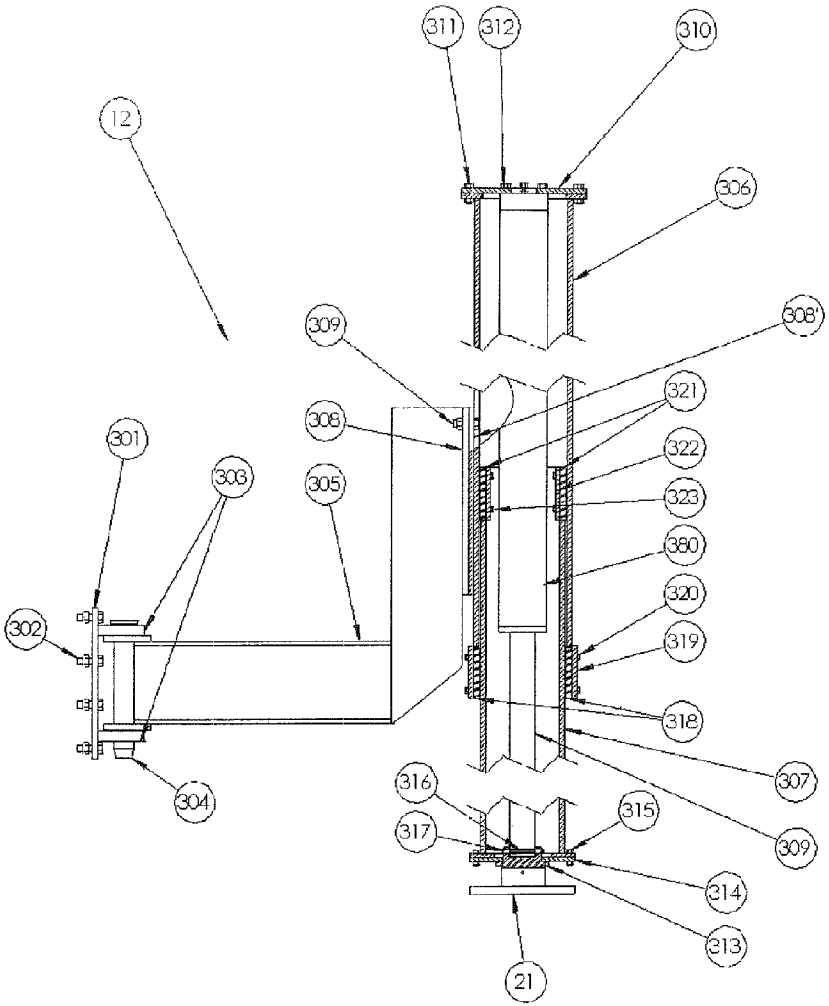
FIG. 17 is a side view of the lifting leg, showing the components comprising the same and including the section view showing the lifting actuator and guide systems.

The details of the four individual legs are shown in FIG. 17 wherein the set of legs is coupled to the chassis 6 through a binding plate 301. This plate has openings used to couple the same to a support having the same number of openings located on the beam 70 of the chassis where threaded fasteners 302 are screwed. This threaded system facilitates assembly and disassembly as well as avoids any kind of welded joint. This plate 301 has at the same time two ears 303 with two openings where two pins 304 are located that completely prevent movement when lifting. These pins 304 also go through two ears through the arm body 305. This is to support the main body of the leg and on the other hand it allows a side oscillatory motion to adopt a transport position relative to one of the pins 304. That is, removal of one of the pins 304 allows the arm to rotate relative to the other pin and in this way the arm is located in the transport position aligned with the longitudinal axis of the equipment.

The body 305 has a binding plate 308 that allows coupling the main body of the leg 306 through a plate of the same dimension and with the same number of openings 308', that is adjusted by means of threaded fasteners 309.

Leg 12 has an inner body 307 that extends internally through the outer or main body 306 allowing increasing its vertical length and therefore making the equipment raise. This inner body 307 as well as the outer body 306 has a square or rectangular section but they can also have a circular or hexagonal section. Internally to the bodies 306 and 307 the actuator 380 is housed, being a hydraulic cylinder or an electro hydraulic or electromechanical actuator. This actuator has a rod 309 that is coupled to the body 307 on its lower portion. When the actuator (rod) extends, the inner body 307 of the leg is extended. In this way the cylinder or actuator 380 is only to push the inner body 307 to extend it while any kind of side force applied to the leg is absorbed by the inner bodies 307 and outer body 306.

At the same time, the actuator is contained and isolated from the environment allowing a higher protection against external agents. The actuator rod 309 is coupled to the lower portion of the leg 307 by the end 313 through a slot in the rod 309 where a setscrew 317 attaches the same in position. This end 313 is attached to a plate 314 having holes that by means of threaded fasteners 315 are attached to the lower body 307 with a flange-type arrangement. On the other hand support to the ground is realized by means of one support surface 21 of standard use in the equipment that can be detached for transportation.

The contact between the lower body 307 and the outer body 306 of the leg is realized through lower wear plates 318 and upper wear plates 321. Plates 318 are integral with the main body 306 while plates 321 are integral with the inner body 307. These plates are supported on the walls of the respective body promoting a good contact and a softer contact area. These plates are housed in the respective bodies through screws 323 and 320. Housing of the wear plates is done by the plate 322 or the plate 319 respectively on each body.

Figure 18A:
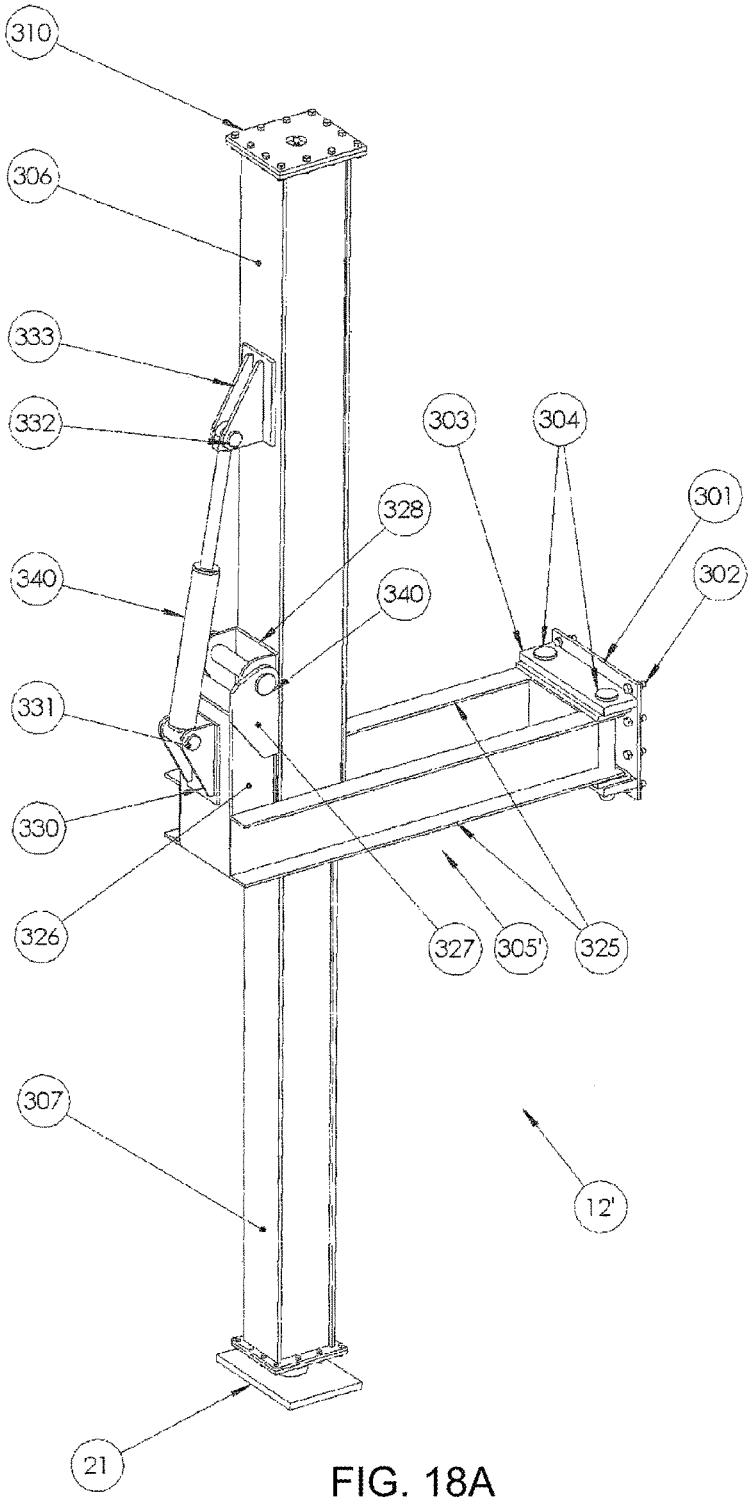
FIG. 18A is a description of the components of an alternative design of the leg shown in FIG. 17 allowing complete retraction of the same under the floor of the tubular pipe handling apparatus.

FIG. 18A shows an alternative design of the leg 12 (hereinafter 12') in the lifting position, allowing that the leg can be retracted underneath the floor line 78 of the chassis 6. To this end the leg keeps the same main body 306 with a telescopic extension 307 to allow lifting vertically, but it differs by the arm body design 305 (hereinafter 305') to allow rotation of the telescopic leg to be retracted horizontally. The leg keeps its configuration of anchor plate 301 to the chassis with their respective bolted joints 302 coupled to the ears 303 wherein by pins 304 is coupled the arm body 305' that has been modified relative to the previous design. This body is different from the previous one as it is configured by two parallel beams 325 coupled by a vertical column 326 on its end. This vertical column 326 has in turn ears 327 on its upper end to couple the arm body with the telescopic leg through ears 328 included in the body 306. In this way and by fixing through a pin 329 the body 306 is able to rotate by this pivotal point. This rotation is performed through a hydraulic actuator 340 (that can be replaced by an electro-hydraulic or electromechanical actuator) attached on one side to the arm column 326 through ears 330 and pin 331 and on the other side to the leg body 306 by another ear 333 and pin 332. In this way, the extension or retraction of the hydraulic cylinder allows the leg body 306 to rotate relative to the pivotal point of the pin 329. This movement must be performed with the leg having its lower body 307 fully retracted and the arm opened, that is, being the legs perpendicular to the longitudinal axis of the equipment. In this way by rotating relative to the pin 329, the leg can be positioned vertically or conversely without colliding with the floor 78 of the chassis 6.

Figure 18C:
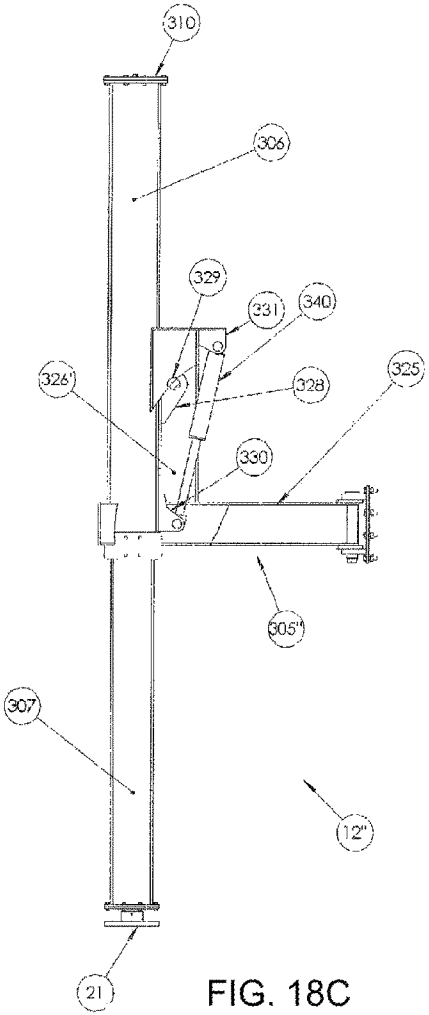
FIG. 18C is a side view of the components of the design alternative of the leg shown in FIG. 18B.
Figure 18B:
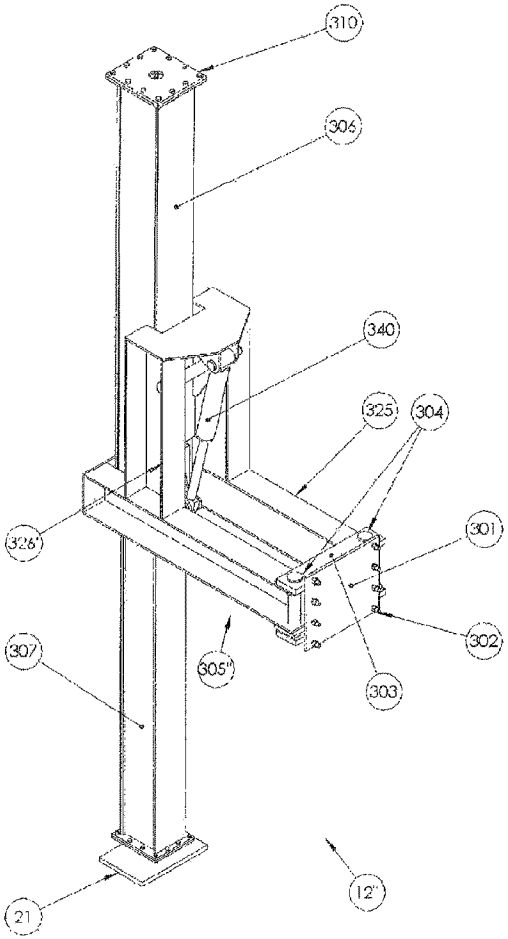
FIG. 18B is a description of the components of a design alternative of the leg shown in FIG. 18A as another embodiment in the rotation position of the support leg with inner rotation center, retracting said leg inside the arm.

Also, FIG. 18B and FIG. 18C show another embodiment wherein the modification is the position of rotation of the support leg 12'. Indeed, the rotation center is internal and the leg 12" is retracted inside the arm body 305". This embodiment is self-locking when lifting, unloading the cylinder of rotation 340 and does not require additional pins for locking.

Figure 19:
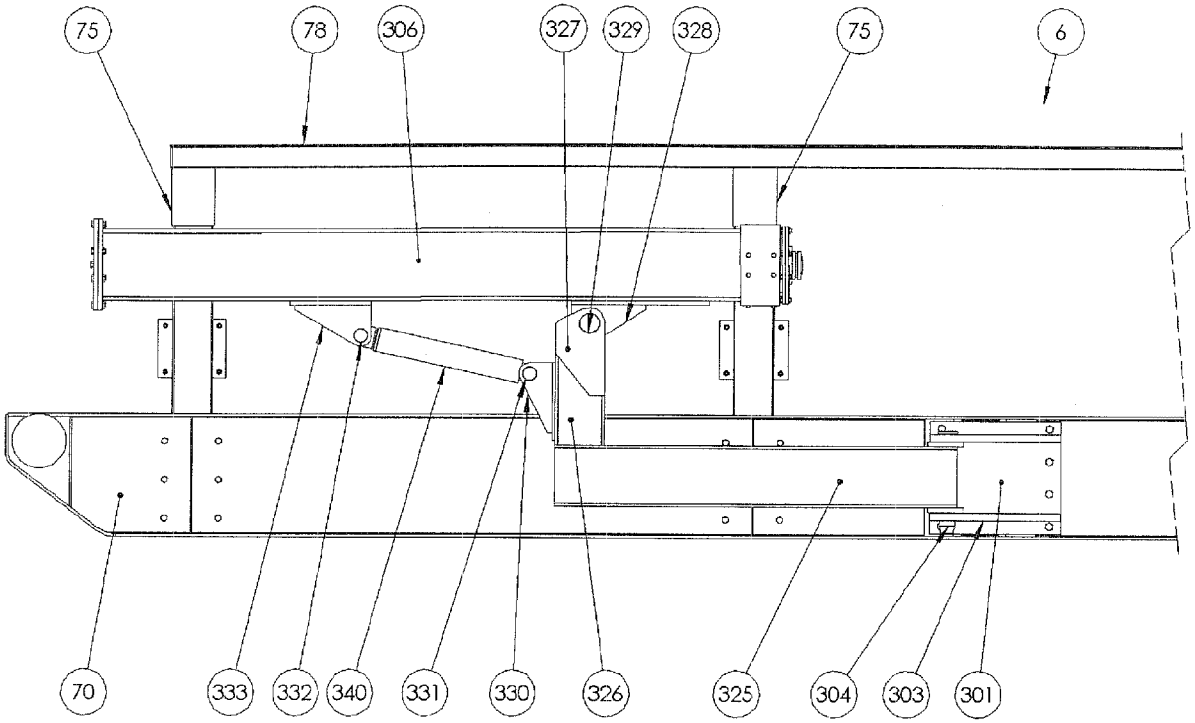
FIG. 19 shows the design alternative of the leg referenced in FIG. 18 mounted on the equipment chassis and in fully retracted position (operative position).

FIG. 19 shows the leg 12' in fully retracted position during operation, wherein it can be seen that unlike the previous design this configuration is completely contained under the floor 78 of the chassis 6.

Figure 20:
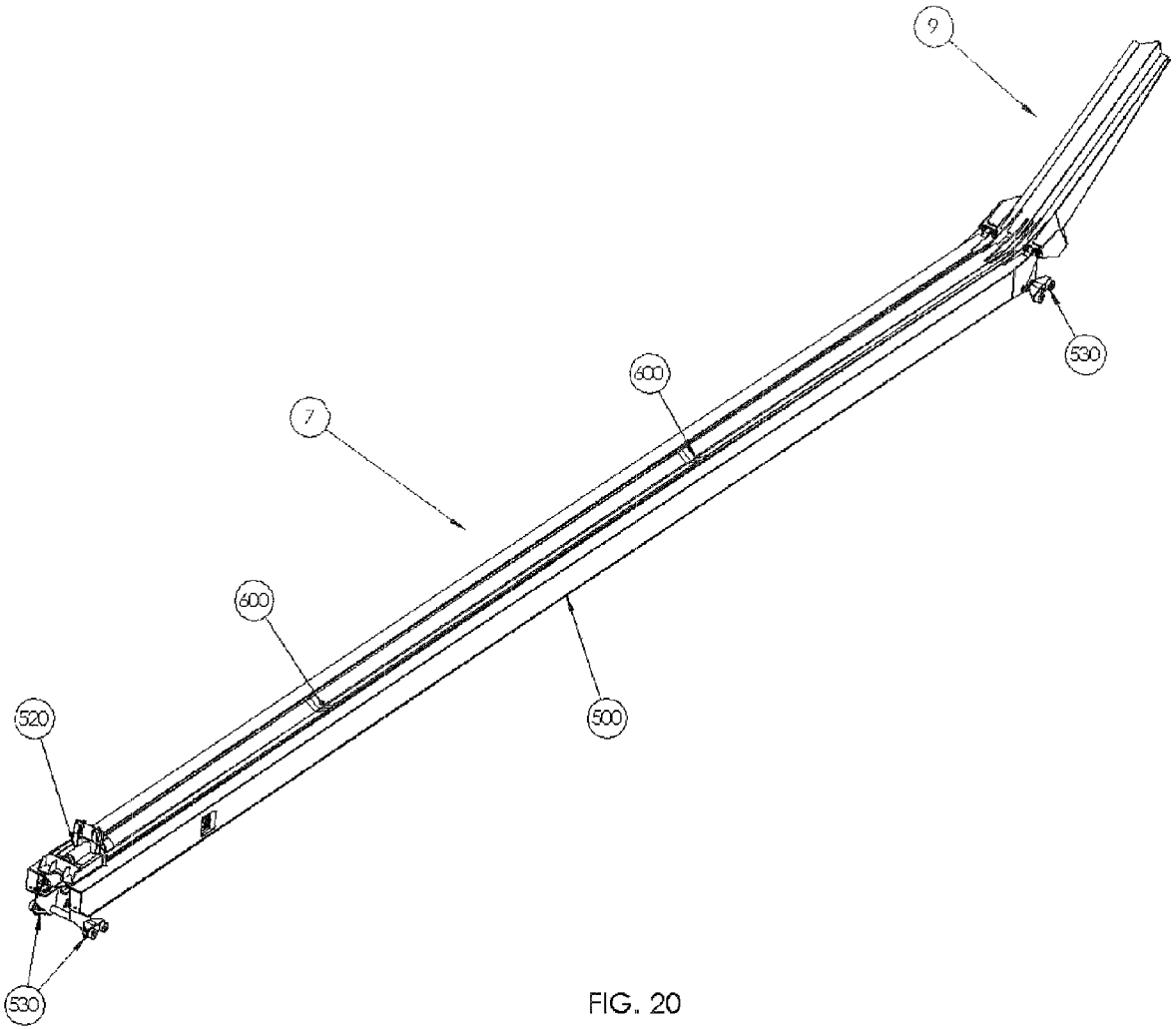
FIG. 20 is an isometric view of the tray and the components comprising the same.
Figure 21:
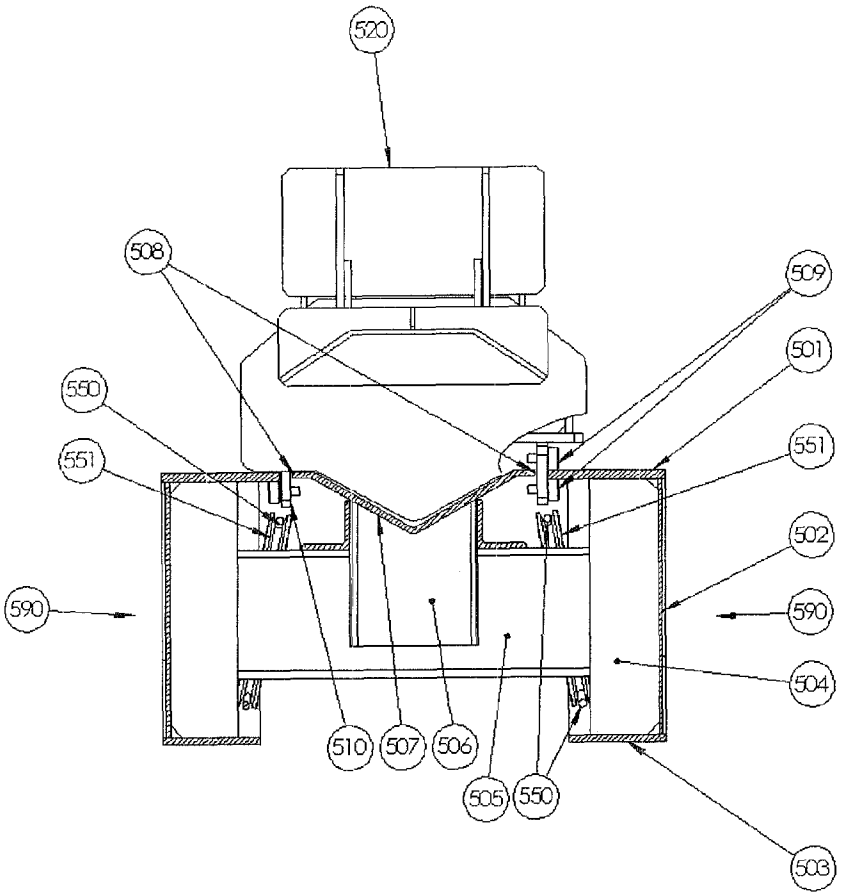
FIG. 21 shows a cross section cutaway view of the tray indicated in FIG. 20 that shows the geometry of the components and elements used to move the carriage.

The main tray raises the tubes from the horizontal retracted position inside the equipment chassis to the upper portion of the inclined plane, that is, to the work table or substructure of the service equipment. FIG. 20 and FIG. 21 show schematically the configuration of the tray. This is in rest position retracted into the cavity formed within the chassis. The tray is formed by a main body 500 which at the ends have wheels or skids that function as guide and support members. These wheels 530 shown in FIG. 20 can be dual wheels running in the case of rear wheels on a guide 209 and front wheels running on the inclined plane 8. At the same time, the tray has a carriage 520 that pushes the tubes once the tray is hoisted to the work table. This carriage can move along almost the total length of the tray. On the other hand there is provided an extension 9 that is coupled to the tray on its front end. To complete the configuration of the tray four derailment means 600 are provided that take the tubes from the tray to the equipment chassis when tubes must be laid down from the work table. They work as small fingers or triggers that push out the tubes once the tray is in the horizontal position.

FIG. 21 shows a cross section of the tray wherein it can be seen that the tray is comprised by two side beams 590 that form the structural portion and the main body of the tray 7. On the other hand these beams formed by a C section profile are comprised by an upper wing 501 and a lower wing 503 joined by a web 502.

Figure 22:
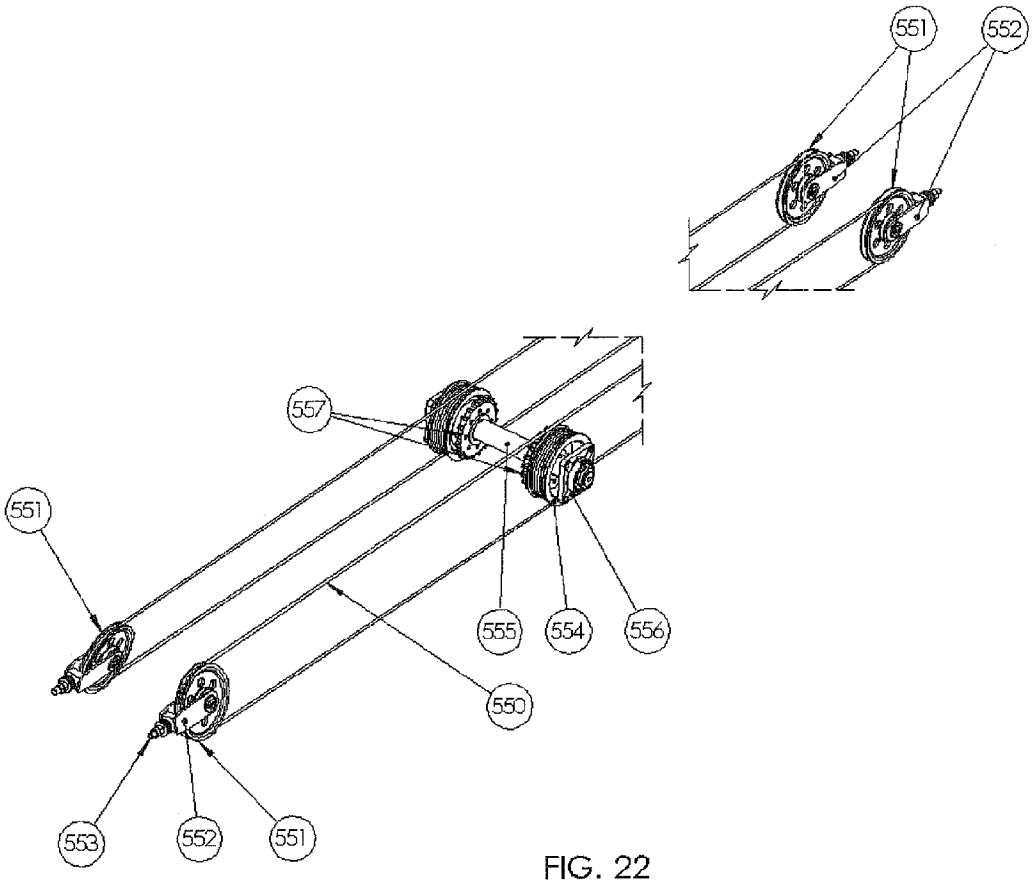
FIG. 22 shows separately the wire driving means of the carriage as well as the elements comprising the same.

These two side profiles have internal stiffeners or ribs 504 and are coupled by crossbars or crosswise structural elements 505 that make up the structure 500. The tray has a V-shaped trough 507 separated from the upper wing of the beams 501 through a small slot 508 along which the carriage 520 can move. These slots allow linking the carriage 520 to its driving system that is underneath and inside the structure 500 of the tray. The driving system consists of a wire rope 550 attached to the carriage ear 520. The trough 507 is connected to the crossbars 505 through columns 506 transmitting the loads to the structure of the tray. Wheels 509 are integral with the carriage 520 and serve as support as well as stop in case the carriage tries to derail. Slots 508 along which the carriage moves run longitudinally by both sides of the trough 507. This allows the driving system to be internal to the tray and not external as commonly used in double driving systems (double wire rope, belt or chain). The driving system can be seen in FIG. 22 wherein the carriage 520 is driven by two wire ropes 550 located under each leg 510 that prolongs through the slots 508.

The steel wire rope 550 covers almost the entire length of the tray and is tensioned by pulleys 551 on the ends. Its movement is performed by winding the wire on a driving drum 554. The system is duplicated (double wire), allowing to create a fail-safe system and is geometrically symmetrical about the longitudinal symmetry plane of the tray.

The front and rear pulleys serve to guide the wire and allow that the upper section remains aligned with the slots where the carriage legs 510 are located. Each pulley has a clevis 552 which is held in position with one bolt 553 that in turn is anchored to the structure of the tray. This bolt serves to hold the clevis and keep the wire ropes with the right tension. On the other hand, shaft 555 holds both drums 554, and this shaft is housed on a bearing system 556 that in turn is attached to the structure of the tray. This drum system allows that wire rope turns in one direction or the other indistinctly. The wire rope forms a closed loop having the terminals coupled to the carriage 520. Shaft rotation is driven by a sprocket 557 in a dual configuration (one at each side) to which the power is transmitted through a chain. The rotary power generator is not depicted in the drawing but can be a hydraulic motor, electric motor, a combustion engine. Transmission is in this case through a system of pinion sprocket and chain, but can also be performed through an orthogonal 90 degrees gearbox.

Figure 23:
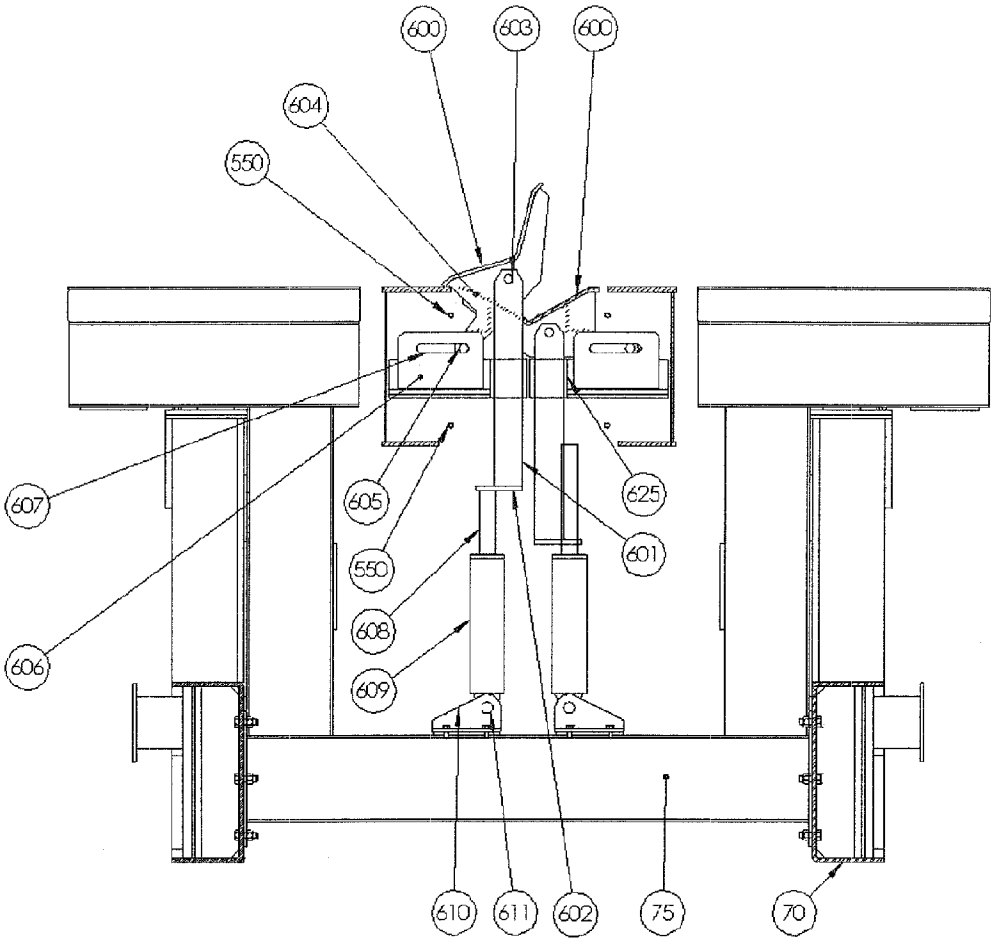
FIG. 23 is a cross section view of the equipment with the tray down and showing the operation and components comprising the derailment system of the tray.

The tray 7 has four derailment means 600 located on the main body. FIG. 23 shows a cross section of the equipment (with the tray retracted) at the position of one of the derailment means 600. Figure shows in detail the driving mechanism of the actuator wherein it can be seen that actuators are positioned externally to the tray 7. These derailment means are in the form of the tray trough and lift to derail or take the tube out towards one or the other side of the equipment. The mechanism is driven by hydraulic cylinders 609 that may be replaced by an electro hydraulic or electromechanical actuator or other kind of linear actuator. These actuators are integral with the chassis 6 of the equipment. The derailment means has a main body 600 that on the upper portion continues the form of the trough of the tray. The derailment means has a body plate 604 coupled to a stem 601 through a pin 603. This stem is vertical and is slightly offset from the central axis of the tray. On the other hand the plate 604 has one end with an extension and a pin 605, which moves through a slot 607. This slot is formed in a guide plate 606 and is integral with the structure of the tray. The stem 601 when moving upwards actuates the plate 604 of the derailment means body that at the same time is retained by the guide, creating the vertical movement and rotation needed. The stem 601 is actuated from outside the tray body through the actuator 609 by displacement of rod 608 that rests on a plate or support body 602 included in the stem 601. This displacement must be vertical, and to achieve so the derailment means support has a guide 625 that makes the stem move linearly and vertically on this body. The cross section of FIG. 23 also shows the area where the wire rope 550 runs and illustrates that is outside the driving line of the derailment means.

FIG. 23 also shows how the body of the chassis is formed, as it can be seen it is composed of two C-shaped longitudinal beams 70 located on the sides and facing outward, coupled to frames 75 that serve as chassis ribs. Cylinders or actuators 609 are coupled to these frames 75 through supports 610 in the form of ears and pins 611. These actuators being coupled to the chassis make the tray inherently safe, as the derailment means cannot be actuated unless the tray is in the right position. That is, it is not possible that the tube leaves the trough unless the tray is in the horizontal resting position.

Figure 24:
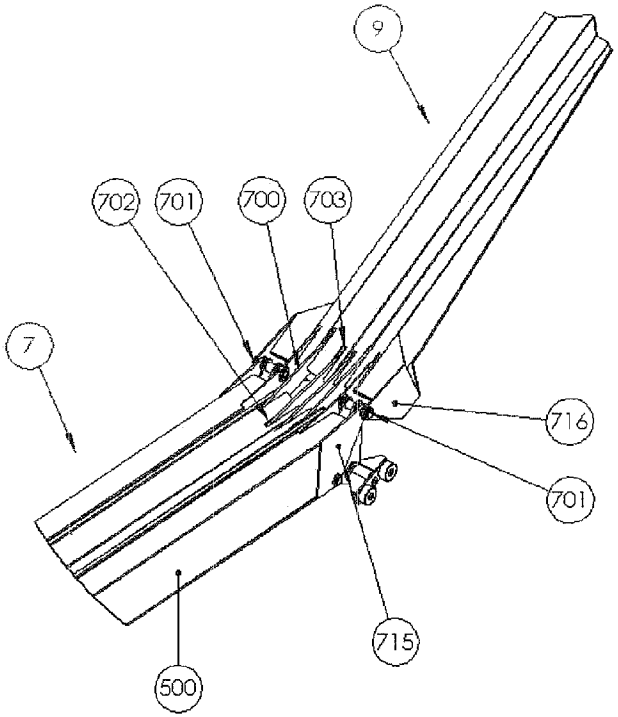
FIG. 24 is an enlarged view of the tray extension and the components of the assembly.
Figure 25:
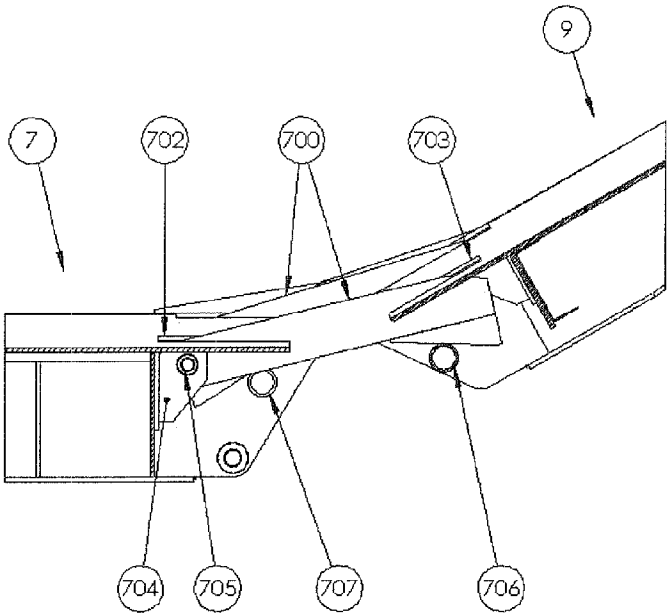
FIG. 25 is a longitudinal cutaway view in the symmetry plane of the tray in the articulated area of the extension.

The tray has an extension 9 on a distal end and serves to approach the wellhead and assist in handling the tubes. This extension receives the tube and allows sliding the same to the main trough of the tray, or vice-versa, extends the tube near the wellhead center to release from the tray. This extension is shown in FIG. 24, FIG. 25, FIG. 26 and FIG. 27 where it is shown that it has a hinge on its end close to the tray body 500 where it rotates and is able to transition from a support position against the inclined plane 8 to a position to receive the tube on the work table geometrically aligned with the tray. To this end the tray has ears 715 and the extension ears 716 which are coupled by a pin 701 forming the hinge. At the same time, the hinge has a "flexible" joint means, so that the tube does not find a sudden change of geometry and locks in case the extension is not in a position fully aligned with the tray. To this end, FIG. 24 and FIG. 25 show the addition of guide plates 700 so that the tube is supported on them and undergoes a smooth transition between the extension 9 and the tray 7. These plates are 4 in this case (may be less or more in number) wherein two plates are inner plates and two plates are outer plates, following the same cross section of the trough. The two inner plates are located in a lower position with respect to the two outer plates, favoring that the contact is in the entire length in the form of a trough (V) so that the tube is not derailed when it is lowered or lifted. These plates 700 slid inside of slots formed in the body 500 of the tray 7 and the extension 9. These slots 702 and 703 allow the plates to cut the geometry of the tray and of the extension and being introduced inside them. FIG. 25 shows a longitudinal plane of symmetry of the tray wherein it can be seen how plates 700 are arranged and how their geometry operates.

Figure 26:
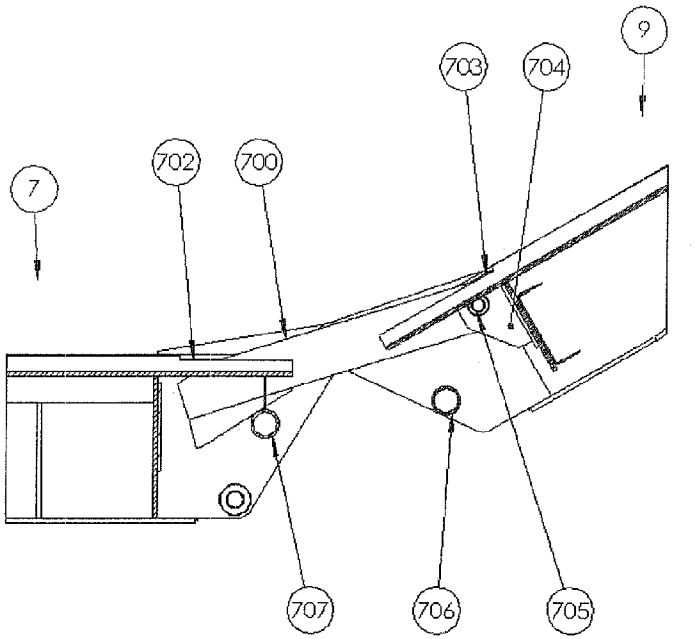
FIG. 26 is a view similar to FIG. 25 but showing a cutaway section in a plane offset to the symmetry plane and showing the geometry of the outer guide plate.
Figure 27:
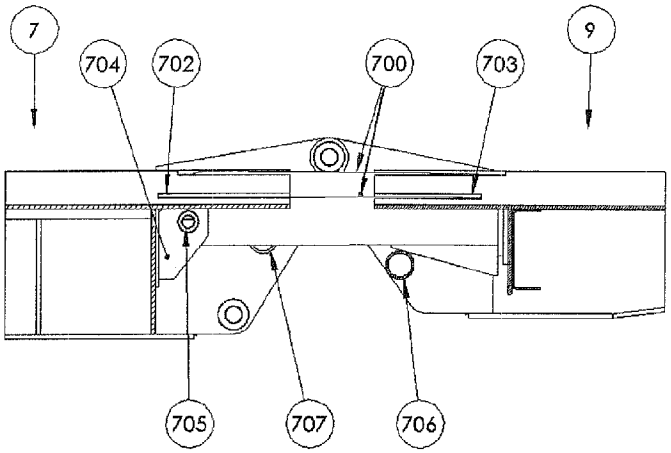
FIG. 27 is the view of FIG. 25 with the extension fully aligned with the tray.

Plates 700 are attached on one side by a pin 705 forming the pivotal point and this pin is in turn coupled by an ear 704 to the tray body 500. On the other hand the plate 700 has a support point on a tube or support body 706 though which it slides during rotation of the extension 9. FIG. 26 shows that in the outer plate movement is similar with the exception that the pivotal point is the side of the extension 9 and the support point or tube is on the body of the tray 500. This switched configuration allows not only saving space but a better movement of the plates. FIG. 27 shows how with the tray 7 being fully aligned with the extension 9 relative to the tray body 500, the plates are aligned with these members and follow at the same time transversely the same shape of the trough (V section).

Figure 28:
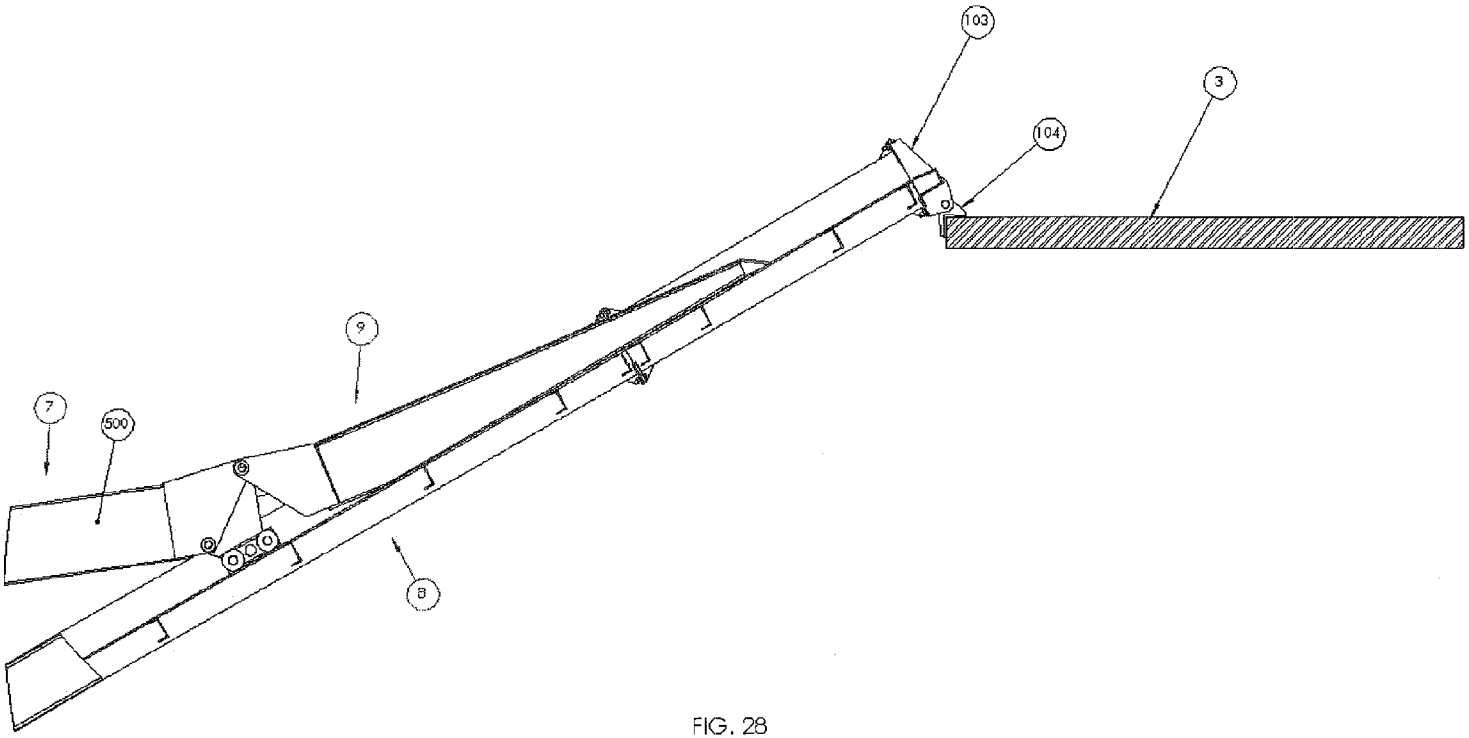
FIG. 28 is a longitudinal cutaway view of the area of the inclined plane with the tray elevated and without reaching the end of the path, showing the positioning of the extension over the tray and the inclined plane.
Figure 29:
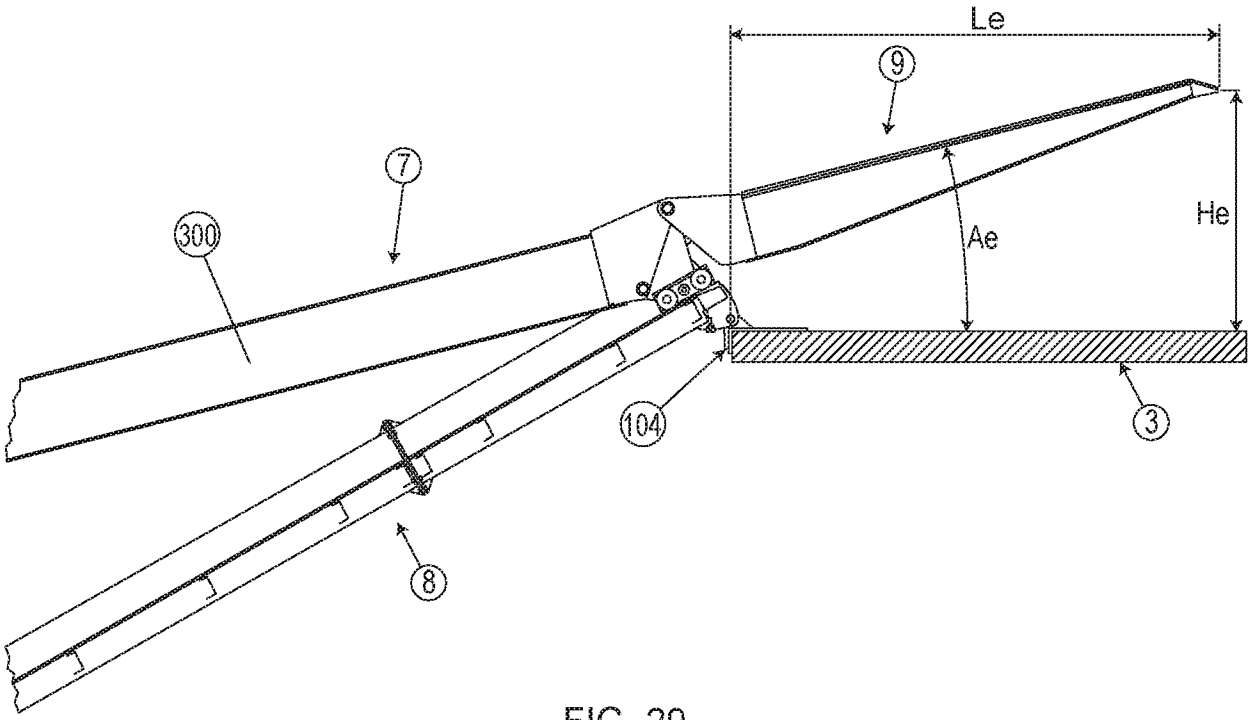
FIG. 29 is a continuation of the movement of FIG. 28 wherein it is shown the tray at the highest position with the extension fully extended.

FIG. 28 and FIG. 29 show the operating principle of the extension 9 and the geometry it creates. It can be seen in FIG. 28 that when lifting the tray 7 the body of the tray 500 is supported by the wheels on the inclined plane 8, and the extension 9 follows the geometry of the inclined plane 8 so that it is always supported on the same. This allows that even in the lowest position (tray down) the equipment keeps working as a conventional apparatus with the use of the inclined plane 8 and the assistance of hoists or winches as the extension 9 is able to receive the tubes from above without going up to the work floor.

Figure 30:
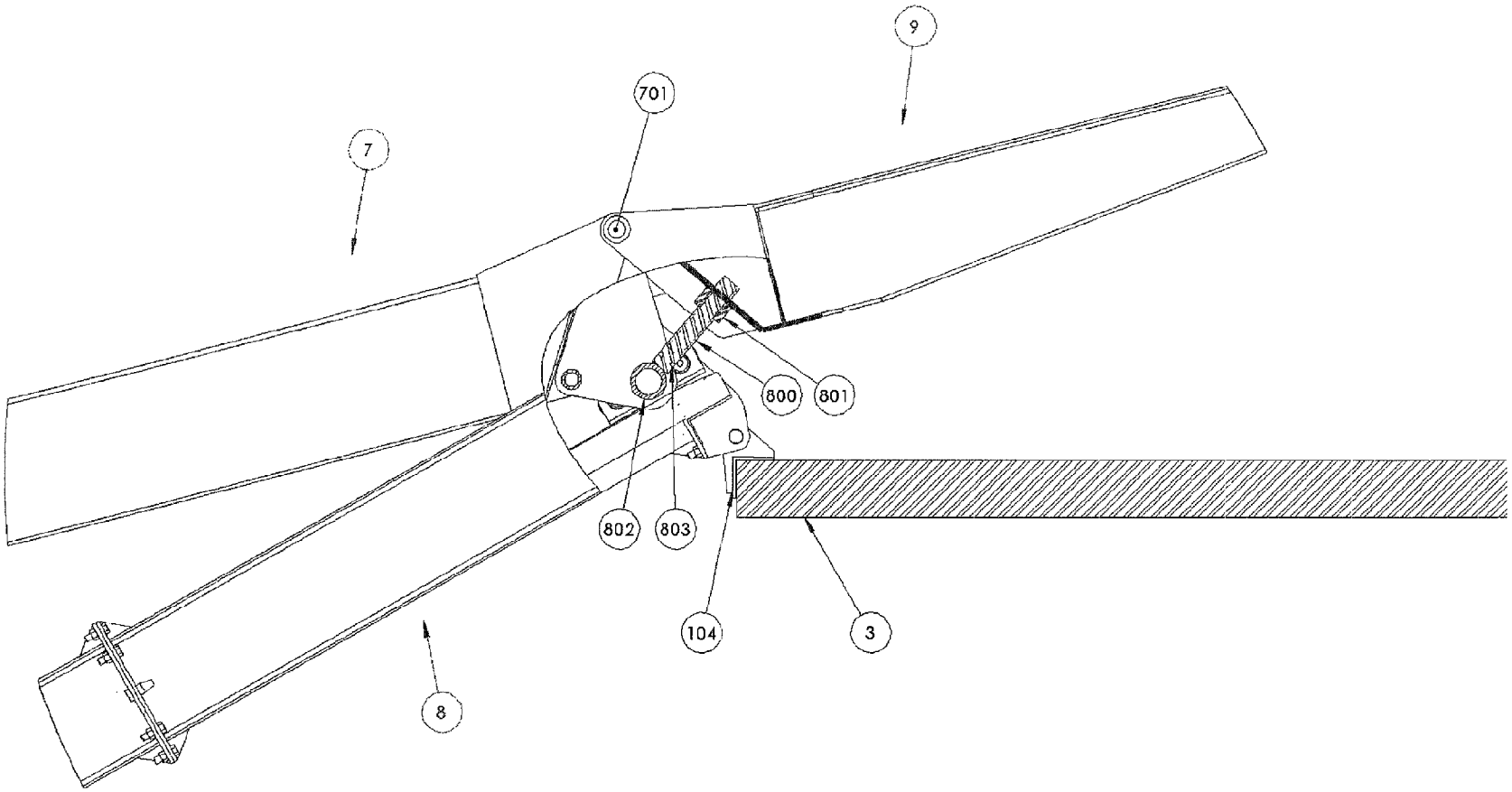
FIG. 30 is a detailed view of the adjustable stop mechanism of the tray extension.

FIG. 29 shows that when the tray gets to the distal end of the inclined plane 8 (support zone 104) the extension 9 is able to fully align with the tray. This position is attained by a simple geometric stop between the extension 9 and the tray 7, according to FIG. 30. The adjustable stop is comprised by a threaded rod 800 assembled to a threaded annular body 801. This threaded annular body 801 is integral with the extension body 9, either by a welded joint or a mechanical joint by threaded members, as screws, bolts or the like. The threaded rod 800 is to make contact with a stop body 802 that is integral with the tray 7. In this way, the extension 9 can rotate relative to the hinge pin 701 until the threaded rod 800 abuts the stop body 802. The final angle between the extension 9 and the tray 7 can be adjusted by varying the thread depth of the threaded rod 800 inside the threaded annular body 801. This can be done by the openings 803 included in the threaded rod 800 that allow the use of a wrench with projections to rotate the stem.

This adjustable stop makes the extension 9 to form an angle Ae relative to the work table that may be higher than the angle of the tray 7 relative to the work table. The effective length Le of the tray extension 9 is proportional to the extension length and the effective angle Ae obtained, so that this extension 9 can be interchangeable to attain certain effective variable length Le and corresponding effective height He relative to the work table. These are the two variables to have in consideration and that affect the correct operation or the safest way to do it. Thus, this extension 9 is detachable through pins 701 so that it can be replaced by another extension of different length according to the height He and the length Le required for the equipment.

Another object of the present invention is a rack lifting means 17 that comprises: a driving system by hydraulic, electro hydraulic or electromechanical cylinder 24 that allows tilting the rack 10 or handling the tube lifting means 35.

The rack lifting means 17 is coupled with threaded elements 106 to the chassis 6 through a quick configuration change support allowing to substitute the mounted rack by another rack of different length or to remove the preload rack 10 to dispose the rack head 17 of the rack directly on the chassis body 6.

Preferably, said rack support 18 is at the same time a leveling leg that ensures correct leveling of the equipment 1 and racks.

In a preferred form, the rack lifting means 17 is embodied in a tube loading and unloading equipment or in pipe baskets.

It is another object of the present invention to provide each of the support and lifting legs 12, with a cylindrical body of rectangular or circular section and vertically aligned with a telescopic inner body actuated by a hydraulic lifting cylinder 380, electromechanical or electro hydraulic actuator used to hoist vertically the equipment.

Said support and lifting legs 12 are detachably coupled to the chassis 6 by threaded fasteners 302, such as screws, bolts or pins. Said lifting cylinder 380 of the support and lifting legs 12 is coupled to a telescopic inner body through a slot in the rod 309 that is inserted in one end 313 and is retained by means of a setscrew 317 acting as a lock, wherein said end 313 is in turn supported on the detachable support plate 314 that contacts the floor and said end 313 is coupled to the telescopic body through a flanged joint.

Support and lifting legs 12 are retractile in the plant view so as to position longitudinally relative to the equipment 1 to allow operation or during transportation or can be rotated and opened to place them at 90 degrees to the longitudinal axis of the equipment 1 during lifting.

Positioning of support and lifting legs 12 is made manually or by means of hydraulic, electro hydraulic or electro mechanical actuators.

The telescopic body of each support and lifting leg 307 and the main body of the leg 306 are contacted through sliding plates located on the cavities on each body.

Support and lifting legs 12 are fully retracted with a lower final height by rotation relative to a pivotal point located at the end of the equipment arm which allows retraction under the work floor of the equipment, wherein driving is performed by a hydraulic cylinder 380, electromechanical or electro hydraulic actuator that rotates each leg 12 in the position of open arms.

In other embodiment, the support and lifting legs 12 are fully retracted with a lower final height by rotation relative to a inner pivotal point located at the end of the equipment arm which allows self-locking retraction inside said arm, wherein driving is performed by a hydraulic cylinder 380, electromechanical or electro hydraulic actuator that rotates each leg 12 in the position of open arms.

Particularly, support and lifting legs 12 are incorporated in equipment that requires transportation such as pipe baskets, containers, operator rooms or any other skid mounted unit that must be transported all kinds of trailers or the like.

Work Methodology

The following summarizes the methodology for the transportation to location (A), assembly (B) loading (C) and unloading (B), and disassembly for transportation (E) of the equipment described hereinabove, for a better understanding of the invention.

A) Transportation of Equipment to Location

1) From the transport position (FIG. 14) placed on the ground extend the legs 12 perpendicular to the longitudinal axis of the equipment and lock with pins 304. In case of retractable legs, rotate to move from the horizontal to vertical position (FIG. 18).
2) Lift the legs 12 to achieve clearance height H (FIG. 16).
3) Place the transportation means for the equipment (any kind of trailer or the like) below it, taking care of not collide with the legs.
4) Lower the legs 12 until the lower portion of the equipment makes contact with the transport surface.
5) Unlock the corresponding pins 304 and fold the legs to the transport position. In case of retractable legs, rotate the body of the leg from the vertical to the horizontal position before positioning beneath the floor of the equipment.
6) Move the equipment to the job location. Align the tube handling apparatus with the service equipment ensuring the correct distances for the inclined plane used and height of the substructure.
7) Repeat step 1 from the elevated transport surface.
8) Repeat step 2.
9) Remove the transportation means from beneath the equipment.
10) Lower the equipment at ground level.
11) Repeat step 5.

B) Equipment Assembly for Operation

1) Position the support surfaces 21 below the threaded rods 20 on the rack support 18 and level de equipment.
2) Extend the inclined plane 8 from its closed position to its support position on the work floor (substructure) using the actuator 110.
3) Deploy the extension 9 from the tray so that it rests on the inclined plane.
4) Deploy the racks 10 perpendicular to the longitudinal axis of the equipment. Lock in position with pin 16.
5) Place the support surfaces 21 under the heads 17.
6) Extend the leg 23 of the rack head 17 to rest on the support surface 21 and tilt the rack 10 ensuring an inclination towards the equipment. Repeat this for all four racks.
7) Lock the drive of the leg in place to allow the use of the tube lifting assembly 35.
8) Place the storage racks 5 to the sides of the equipment ensuring perpendicularity to the longitudinal axis and leveling. Load with tubes or bars to be used (FIG. 2).

C) Equipment Operation: Loading

1) Load with tubes the preload racks 10 from the storage racks 5 by operating the tube lifting assembly 35. The tubes will slide on the inclined plane formed by the pair of preload racks 10 to its inner end. Load as many tubes as possible from both sides of the equipment.

2) Assisted by the indexer elements 11, load a tube of either side of the equipment. When lifting the indexer arm the tube will roll to the center of the equipment finally being contained in the center V-shaped cavity of the tray 7.
3) Through the operation of the actuator 200 move the tray 7 supported at one end on the inclined plane and on the other on the guides 209. Continue the movement to cover the length of the inclined plane.
4) At the end of the inclined plane 8 the extension 9 rotates aligning with the tray body and getting closer to the center axis of the wellhead.
5) Push the tube by means of the carriage 520 until the end of it can be manipulated by the operator on the work floor. Hook by means of the elements of the service equipment and handle pulling upwards to remove it of the tray completely and position vertically on the work floor.
6) Slide the carriage 520 backwards to the start position in the tray.
7) Lower the whole tray 7 until completely contained within the body of the equipment.
8) Repeat steps 2 to 7 until all required tubes are loaded. After certain number of cycles repeat step 1 so as to maintain the load of preload racks 10.

D) Equipment Operation: Download

1) Realign the preload racks 10 (STEPS 6 and 7 of the ASSEMBLY OPERATION) now ensuring tilting outwardly of the equipment (to the storage racks 5).
2) Through the operation of the actuator 200 move the tray 7 supported at one end on the inclined plane and on the other on the guides 209. Continue the movement to cover the length of the inclined plane.
3) At the end of the inclined plane 8, the extension 9 rotates aligning to the tray body and getting closer to the center axis of the wellhead.
4) Move the carriage 520 forwards on the tray approaching the distal end near the work floor.
5) Manipulate using the elements of the service equipment the pipe vertically placed on the work floor, taking the lower end of the tube until it rests on the extension 9 of the tray. As the tube continues lowering, it will slide over the V shaped cavity of the extension, the plates 700 of the hinge and the V shaped cavity of the tray until it stops with the carriage 520. Continue lowering the tube with the assistance of the carriage to prevent it from derailing until the tube gets fully supported on its upper end and can be disengaged of the manipulation elements of the service equipment.
6) Once the tube is disengaged, move the carriage 520 to its start position in the tray, moving the tube that rests upon it.
7) Lower the whole tray until completely contained within the body of the equipment.
8) Using a pair of derailment means 600 and by operating the actuators 609, push the tube toward either side of the equipment. The pipe will roll freely until the end of the preload rack 10 to abut against the cavity 44 of the rack head 17 or against another tube previously downloaded.
9) If necessary download tubes of both sides of the equipment racks from the preload racks 10 toward the storage racks 5 operating the tube lifting assembly 35.
10) Repeat steps 2 to 8 (and 9 if necessary) to complete the unload operation.

D) Disassembly of Equipment for Transportation

1) Perform the assembly operation of equipment B in inverse order.

What is claimed is:

1. A tubular pipe handling apparatus, consisting of a chassis, an inclined plane, a tray with an extension and side racks, the apparatus comprising:

a tube lifting tray with an extension on its end, detachable and capable of rotating to reach a wellhead center, wherein said tray is actuated from its rear portion and pushed to be transferred when supported by the inclined plane;

at least a pair of racks on one side of the apparatus having a hinge system with a pin block on a hinge or self-lock to perfectly align and lock at 90 degrees, being an assembly bolted to a main body of the chassis;

rack lifting means that inclines the rack and also transfers tubes from and outwardly from the rack independently to storage racks or pipe baskets;

an inclined plane, which total length is adjustable by means of extensions to accommodate the required operation height of a substructure, with extensions that are assembled with each other with threaded fasteners and having a centering pin; and four support and lifting legs included in the chassis that elevate the apparatus to place it on a trailer for transport.

2. The apparatus of claim 1, wherein said tray extension comprises a hinge allowing moving from a support position on the inclined plane to a position aligned with the tray continuing its geometry and allowing bringing the tray close to the wellhead center.

3. The apparatus of claim 2, wherein said tray extension has on the hinge a plurality of slots with plates that follow a relative movement of the extension in reference to the tray, allowing a gradual transition of the geometry of a trough between a body of the tray and the extension thereof.

4. The apparatus of claim 3, wherein said plates have a pivotal point at one of their ends and a support point on the other that allow displacing with the extension movement.

5. The apparatus of claim 1, wherein said tray extension is detachable and replaceable by another extension to adapt the tray to the geometry required by a worktable.

6. The apparatus of claim 1, wherein said extension and tray body allow operation as a conventional catwalk when the tray is not active.

7. The apparatus of claim 1, wherein said tray extension is positioned relative to a tray body by an adjustable geometric stop.

8. The apparatus of claim 1, wherein said rack is assembled by threaded fasteners to the chassis through a quick configuration change support allowing substituting the mounted rack by another rack of a different length or removing a preload rack to place a rack head directly on the chassis body.

9. The apparatus of claim 8, wherein said rack support is at the same time a leveling leg ensuring correct leveling of equipment and racks.

10. The apparatus of claim 1, wherein said rack lifting means comprises:

a hydraulic, electro hydraulic or electromechanical cylinder driving system that allows tilting the rack or handling tube lifting means.

11. The rack lifting means of claim 10, wherein it is assembled with threaded fasteners to the chassis through a quick configuration change support allowing substituting the mounted rack by another rack of a different length or removing a preload rack to place a rack head directly on the chassis body.

12. The apparatus of claim 1, wherein said inclined plane comprises:

a driving system to move from a transport position to an operative position through a set of connecting rods and an eccentric fork with an angle of rotation of 150 degrees in a single operation and with only one actuator, the eccentric fork and a bridge connecting rod to an inclined plane body, which rotation points are on an anchor ear and the geometry amplifies linear movement of the actuator to a rotary movement;

wherein said anchor ear is bolted to the chassis on an extension thereof that raises the same relative to chassis rails.

13. The apparatus of claim 1, wherein said tray is actuated by pushing from the rear, so a support at a front of the inclined plane allows sliding towards a work floor.

14. The apparatus of claim 1, wherein said tray is actuated by a push system that comprises a hydraulic cylinder or an electromechanical or electro hydraulic actuator, with magnified displacement by a wire rope, belt or chain system and set of pulleys, and that moves longitudinally on a same rear support guide of the tray, and wherein said push system can be replaced by a drum system with wire rope, winch or lifting means that anchors its wire rope on a rear portion of the tray and when winding or unwinding moves the tray, and wherein the winch can be actuated by a hydraulic motor, an electric motor or a thermal engine.

15. The apparatus of claim 1, wherein the tray comprises:

a main body formed by two beams with a C-shaped cross section, with inner ribs and crossbeams;

a V-shaped trough for housing the tubes, separated from the beams by two side slots, which serve as guides and a connection cavity of the carriage with driving system; and a set of derailment means located in the main body of the tray.

16. The apparatus of claim 15, wherein the driving system is inside the tray, and is driven by pulleys and wire ropes or chains that move inside and in duplicate.

17. The apparatus of claim 16, wherein the wire rope pull is conducted through two drums wherein a few turns are wound, meeting these drums on a common axis and being driven by a dual system of pinion, sprocket and chain and/or a system of orthogonal gearbox driven by a hydraulic, electric or thermal engine.

18. The apparatus of claim 15, wherein the set of derailment means is driven externally to the tray by linear actuators mounted in an equipment chassis acting on the tray mechanism only at the rest position or the set of derailment means is actuated through a stem and a slotted body that rotate and displace the derailment means.

19. The apparatus of claim 1, wherein the chassis is a structure that comprises beams and frames connected by threaded elements.

* * * * *